US011644762B2

(12) United States Patent
Kinuta et al.

(10) Patent No.: US 11,644,762 B2
(45) Date of Patent: May 9, 2023

(54) IMAGE FORMING APPARATUS AND PROCESS CARTRIDGE

(71) Applicant: FUJIFILM Business Innovation Corp., Tokyo (JP)

(72) Inventors: Yasuhiko Kinuta, Kanagawa (JP); Yuki Tagawa, Kanagawa (JP); Takuya Yamamoto, Kanagawa (JP); Ken Ozaki, Kanagawa (JP); Noboru Hirakawa, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/584,363

(22) Filed: Jan. 25, 2022

(65) Prior Publication Data

US 2023/0064838 A1 Mar. 2, 2023

(30) Foreign Application Priority Data

Aug. 20, 2021 (JP) ..... JP2021-135202

(51) Int. Cl.
*G03G 15/02* (2006.01)
*G03G 21/18* (2006.01)

(52) U.S. Cl.
CPC ..... *G03G 15/0233* (2013.01); *G03G 21/1814* (2013.01)

(58) Field of Classification Search
CPC ..... G03G 15/0216; G03G 15/0233; G03G 21/1814
See application file for complete search history.

(56) References Cited

U.S. PATENT DOCUMENTS

| | | | | |
|---|---|---|---|---|
| 4,848,141 | A | 7/1989 | Oliver et al. | |
| 2005/0152722 | A1* | 7/2005 | Tawada | G03G 21/0005 399/346 |
| 2014/0219682 | A1* | 8/2014 | Tsu | G03G 15/0233 399/176 |
| 2015/0003872 | A1* | 1/2015 | Taniguchi | G03G 15/0233 399/176 |
| 2019/0187581 | A1* | 6/2019 | Adachi | G03G 15/20 |

FOREIGN PATENT DOCUMENTS

| | | |
|---|---|---|
| JP | 2004109242 | 4/2004 |

* cited by examiner

*Primary Examiner* — Hoang X Ngo
(74) *Attorney, Agent, or Firm* — JCIPRNET

(57) ABSTRACT

An image forming apparatus includes an electrophotographic photoreceptor having a friction coefficient of a surface of 0.8 or less; a charging device including a charging member that is in contact with and charges the surface of the electrophotographic photoreceptor and includes a conductive base material, an elastic layer provided on the conductive base material and having a storage elastic modulus G of 5.0 MPa or less at 100 Hz, and a surface layer provided on the elastic layer; an electrostatic latent image forming device that forms an electrostatic latent image on the charged surface of the electrophotographic photoreceptor; a developing device that develops the electrostatic latent image formed on the surface of the electrophotographic photoreceptor to form a toner image by a developer containing a toner; and a transfer device that transfers the toner image to a surface of a recording medium.

18 Claims, 3 Drawing Sheets

IMAGE FORMING APPARATUS AND PROCESS CARTRIDGE

CROSS-REFERENCE TO RELATED APPLICATIONS

This application is based on and claims priority under 35 USC 119 from Japanese Patent Application No. 2021-135202 filed Aug. 20, 2021.

BACKGROUND

(i) Technical Field

The present disclosure relates to an image forming apparatus and a process cartridge.

(ii) Related Art

JP2004-109242A discloses a "process cartridge including at least an image carrier on which a toner image formed by spherical toner is formed, a cleaning blade in contact with the image carrier, and charging roller that is in contact with the image carrier and superimposes and applies a direct current voltage and an alternating current voltage thereto, in which in a case where a loss tangent tan δ of the cleaning blade in accordance with JIS K 7198 is A and an Asker C hardness of the charging roller is B, a relationship of $0.1<A\times B<30$ is satisfied.

SUMMARY

Aspects of non-limiting embodiments of the present disclosure relate to an image forming apparatus and a process cartridge, the image forming apparatus including an electrophotographic photoreceptor having a friction coefficient of a surface of 0.8 or less, and a charging device that is in contact with and charges the surface of the electrophotographic photoreceptor and includes a conductive base material, an elastic layer provided on the conductive base material, and a surface layer provided on the elastic layer, in which a streaky image defect is suppressed, compared to a case where a storage elastic modulus G of the elastic layer of the charging member is more than 5.0 MPa at 100 Hz.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

As specific means, the following aspects are contained.

According to an aspect of the present disclosure, there is provided an image forming apparatus including an electrophotographic photoreceptor having a friction coefficient of a surface of 0.8 or less; a charging device including a charging member that is in contact with and charges the surface of the electrophotographic photoreceptor and includes a conductive base material, an elastic layer provided on the conductive base material and having a storage elastic modulus G of 5.0 MPa or less at 100 Hz, and a surface layer provided on the elastic layer; an electrostatic latent image forming device that forms an electrostatic latent image on the charged surface of the electrophotographic photoreceptor; a developing device that develops the electrostatic latent image formed on the surface of the electrophotographic photoreceptor to form a toner image by a developer containing a toner; and a transfer device that transfers the toner image to a surface of a recording medium.

BRIEF DESCRIPTION OF THE DRAWINGS

Exemplary embodiment(s) of the present invention will be described in detail based on the following figures, wherein.

DETAILED DESCRIPTION

Figure 1:
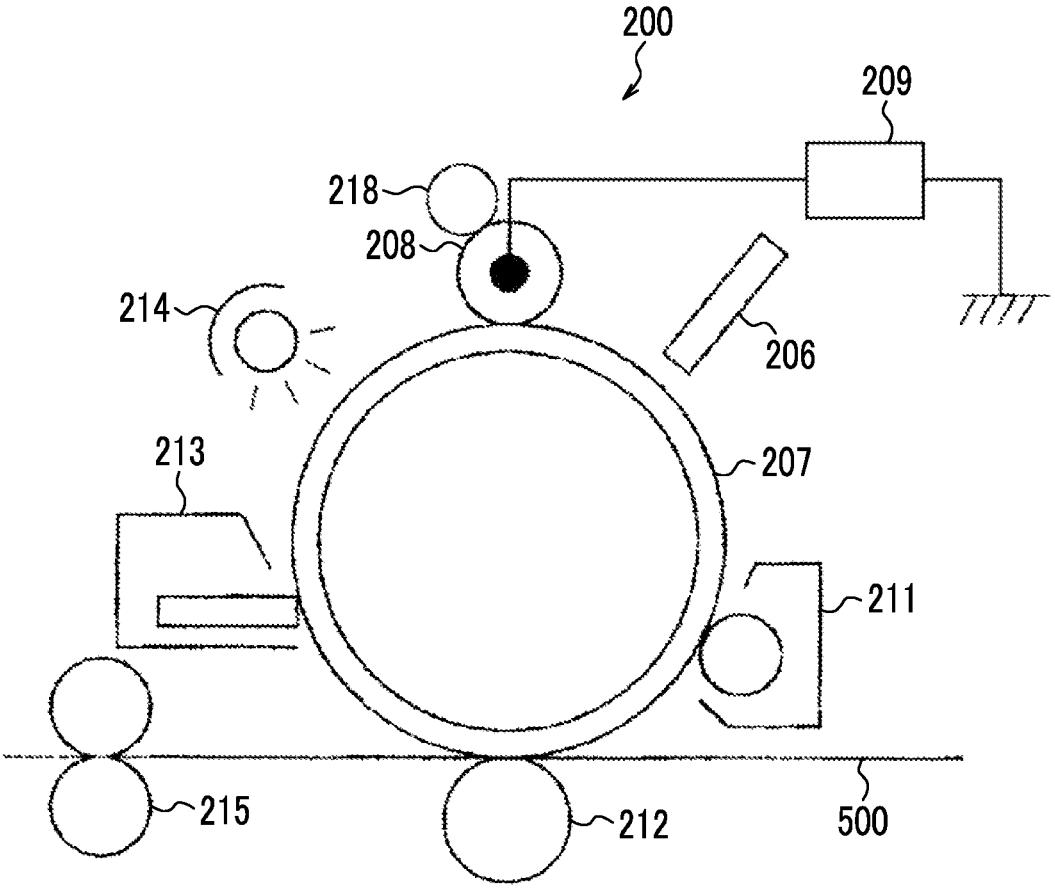
FIG. 1 is a schematic configuration diagram showing an example of an image forming apparatus according to the present exemplary embodiment.

Hereinafter, exemplary embodiments which are examples of the present disclosure will be described. These descriptions and examples illustrate the exemplary embodiments and do not limit the scope of the exemplary embodiments of the present disclosure.

In a numerical range described stepwise in the present specification, an upper limit value or a lower limit value described in one numerical range may be replaced with an upper limit value or a lower limit value of another numerical range described stepwise. Further, in a numerical range described in the present specification, an upper limit value or a lower limit value of the numerical range may be replaced with a value shown in examples.

In a case where the amount of each component in a composition is mentioned in the present specification and plural kinds of substances corresponding to each component are present in the composition, unless otherwise specified, the amount means a total amount of the plural kinds of substances present in the composition.

In the present specification, an "electrophotographic photoreceptor" is also simply referred to as a "photoreceptor".

In the present specification, an "axial direction" of a charging member means a direction in which a rotation axis of the charging member extends. A "circumferential direction" means a rotation direction of the charging member.

Also, in the present specification, "conductive" means that a volume resistivity at 20° C. is $1\times10^{14}\Omega\cdot$cm or less.

Image Forming Apparatus

An image forming apparatus according to the present exemplary embodiment includes an electrophotographic photoreceptor; a charging device including a charging member that is in contact with and charges the surface of the electrophotographic photoreceptor; an electrostatic latent image forming device that forms an electrostatic latent image on the charged surface of the electrophotographic photoreceptor; a developing device that develops the electrostatic latent image formed on the surface of the electrophotographic photoreceptor to form a toner image by a developer containing a toner; and a transfer device that transfers the toner image to a surface of a recording medium. As the electrophotographic photoreceptor, an electrophotographic photoreceptor having a friction coefficient of a surface of 0.8 or less is applied. Moreover, as the charging member, a charging member including a conductive base material, an elastic layer that is provided on the conductive base material, and has a storage elastic modulus G of 5.0 MPa or less at 100 Hz, and a surface layer that is provided on the elastic layer is applied.

In the image forming apparatus according to the present exemplary embodiment, a streaky image defect is suppressed by the above configuration. The reason is presumed as follows.

The charging member that is in contact with and charges the surface of the photoreceptor is driven to rotate as the photoreceptor rotates. However, in a case where a photoreceptor having a low friction coefficient of a surface of 0.8 or less (for example, a photoreceptor having a protective layer to impart wear resistance is provided on the photosensitive layer) is applied as the photoreceptor, the charging member may slip and cause a driven failure. In a case where the driven failure of the charging member occurs, the amount of a toner and an external additive adhering to the surface of the charging member increases due to rubbing between the charging member and the photoreceptor. Moreover, a volume resistance of the adhesion portion of the toner and the external additive in the charging member increases, charging becomes poor and a streaky image defect occurs.

On the other hand, in a case where the charging member having an elastic layer having a storage elastic modulus G of 5.0 MPa or less at 100 Hz is applied, the driven failure of the charging member is suppressed.

Here, the storage elastic modulus G is a storage elastic modulus of the elastic layer at 100 Hz. In the image forming apparatus, the charging member operates at a high rotation speed of 100 Hz or higher in general. That is, the expression that the storage elastic modulus G is low means that the storage elastic modulus of the elastic layer in the charging member that operates at the high rotation speed of 100 Hz or higher is low. Moreover, in a case where the storage elastic modulus G is low, the electrophotographic photoreceptor bites into the charging member at a contact portion between the charging member and the electrophotographic photoreceptor, and a contact width becomes long.

Therefore, since the charging member is easily driven by the photoreceptor, the driven failure of the charging member is suppressed, and an increase in the amount of the toner and the external additive adhered to the surface of the charging member is also suppressed.

From the above, it is presumed that the image forming apparatus according to the present exemplary embodiment suppresses a streaky image defect.

As the image forming apparatus according to the present exemplary embodiment, a well-known image forming apparatus including at least one selected from the group consisting of a fixing device that fixes a toner image on a recording medium; a cleaning device that cleans the surface of a photoreceptor after transfer of the toner image and before being charged; and a static elimination device that irradiates the surface of the photoreceptor after transfer of the toner image and before being charged, with light to eliminate static electricity is adopted.

The image forming apparatus according to the present exemplary embodiment may be any of a direct transfer type apparatus that directly transfers a toner image formed on the surface of the electrophotographic photoreceptor to a recording medium, and an intermediate transfer type device that primary transfers the toner image formed on the surface of the electrophotographic photoreceptor to the surface of an intermediate transfer body, and secondarily transfers the toner image transferred to the surface of the intermediate transfer body to the surface of the recording medium.

Here, in the image forming apparatus according to the present exemplary embodiment, the charging device may be a charging device further including a charging member cleaning member that cleans the outer peripheral surface of the charging member.

The charging device may adopt a method of applying only a direct current voltage (DC charging method), a method of applying only an alternating current voltage to the charging member (AC charging method), and a method of applying a voltage in which an alternating current voltage is superimposed on a direct current voltage to the charging member (AC/DC charging method).

Further, the charging device may be a charging device further including an application unit that applies only a direct current voltage to the charging member, a charging device further including an application unit that applies only an alternating current voltage to the charging member, and a charging device further including an application unit that applies a superimposed voltage, in which a direct current voltage and an alternating current voltage are superimposed, to the charging member.

Hereinafter, a configuration of the image forming apparatus according to the present exemplary embodiment will be described with reference to the drawings.

Figure 2:
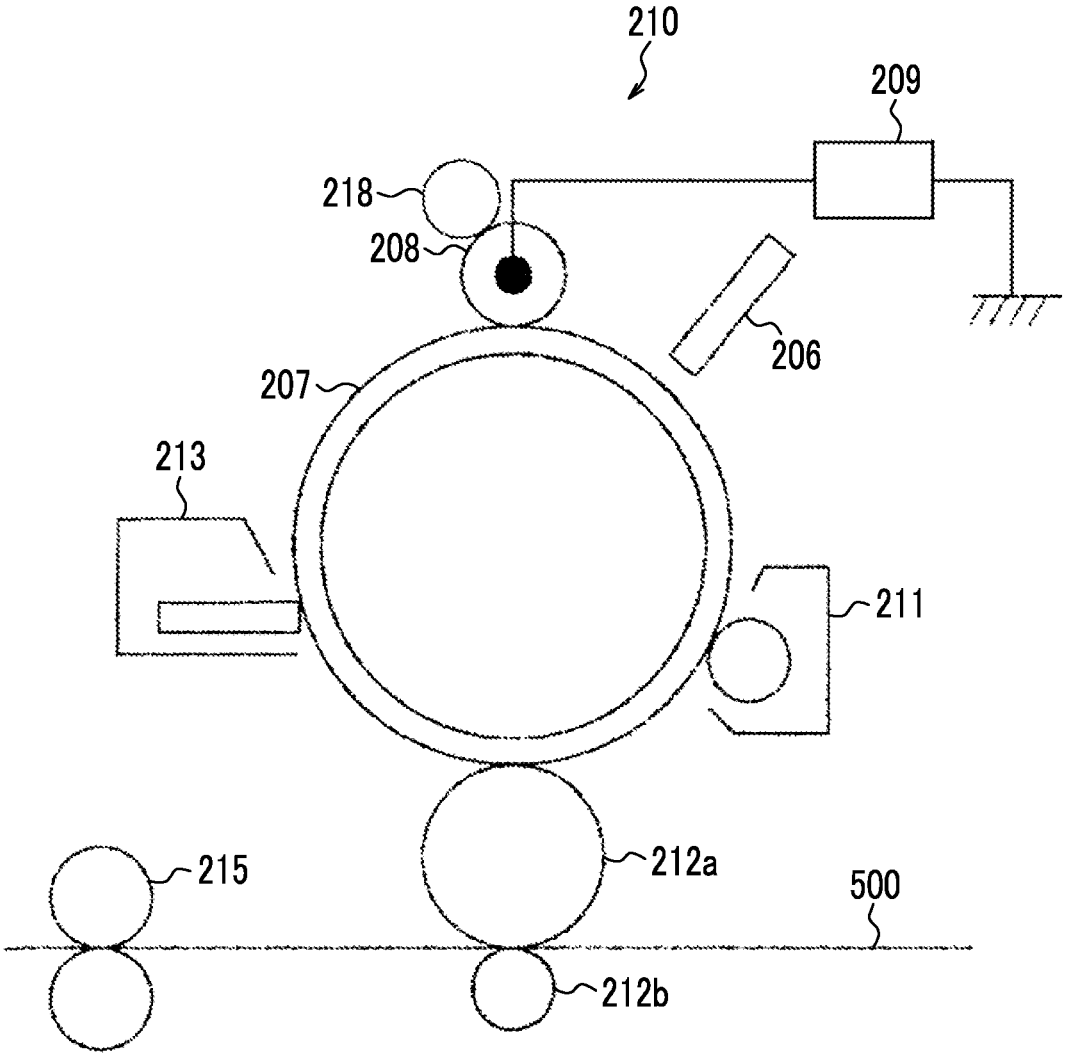
FIG. 2 is a schematic configuration diagram showing another example of the image forming apparatus according to the present exemplary embodiment.

FIG. 1 is a schematic configuration diagram showing an example of an image forming apparatus according to the present exemplary embodiment. FIG. 1 is a schematic diagram showing a direct transfer type image forming apparatus. FIG. 2 is a schematic configuration diagram showing another example of the image forming apparatus according to the present exemplary embodiment. FIG. 2 is a schematic diagram showing an intermediate transfer type image forming apparatus.

An image forming apparatus 200 shown in FIG. 1 includes an electrophotographic photoreceptor (also simply referred to as a "photoreceptor") 207, a charging member 208 that charges a surface of the photoreceptor 207, a power supply 209 (an example of an application unit) that is connected to the charging member 208, a charging member cleaning member 218 that cleans the outer peripheral surface of the charging member 208, an exposure device 206 (an example of electrostatic latent image forming device) that exposes the surface of the photoreceptor 207 to form a latent image, a developing device 211 that develops the latent image on the photoreceptor 207 by a developer containing a toner, a transfer device 212 that transfers the toner image formed on the photoreceptor 207 to a recording medium 500, a fixing device 215 that fixes the toner image to the recording medium 500, a cleaning device 213 that removes toner remaining on the photoreceptor 207, and static elimination device 214 that eliminates static electricity of the surface of the photoreceptor 207. The static elimination device 214 may not be provided.

Here, in the image forming apparatus 200, the charging device is configured of the charging member 208, the power supply 209, and the charging member cleaning member 218.

An image forming apparatus 210 shown in FIG. 2 includes a photoreceptor 207, a charging member 208, a power supply 209, a charging member cleaning member 218, an exposure device 206, a developing device 211, and a primary transfer member 212*a* and a secondary transfer member 212*b* which transfer the toner image formed on the photoreceptor 207 to the recording medium 500, a fixing device 215, and a cleaning device 213. The image forming apparatus 210 may include a static elimination device as in the image forming apparatus 200.

Here, in the image forming apparatus 210, the charging device is configured of the charging member 208, the power supply 209, and the charging member cleaning member 218.

In the photoreceptor 207, an electrostatic latent image is formed by charging and exposure, and a toner image is formed by developing. The details of the photoreceptor 207 will be described later.

The charging member 208 is a contact charging type charging member that is consisting of made of a roll-shaped charging member and in contact with the surface of the photoreceptor 207 to charge the surface of the photoreceptor 207. A voltage of only the direct current voltage, only the alternating current voltage, or a voltage obtained by superimposing the alternating current voltage on the direct current voltage is applied to the charging member 208 from the power supply 209. The details of the charging member 208 will be described later.

Examples of the exposure device 206 include an optical system apparatus including a light source such as a semiconductor laser and a light emitting diode (LED).

The developing device 211 is a device that supplies a toner to the photoreceptor 207. The developing device 211 forms the toner image by, for example, bringing a roll-shaped developer holder in contact with or close to the photoreceptor 207 and adheres the toner to the latent image on the photoreceptor 207.

Examples of the transfer device 212 include a conductive roll that presses against the photoreceptor 207 via a corona discharge generator and a recording medium 500.

Examples of the primary transfer member 212*a* include a conductive roll that rotates in contact with the photoreceptor 207. Examples of the secondary transfer member 212*b* include a conductive roll that presses against the primary transfer member 212*a* via the recording medium 500.

Examples of the fixing device 215 include a heating fixing device including a heating roll and a pressure roll that presses against the heating roll.

Examples of the cleaning device 213 include a device provided with a blade, a brush, a roll, and the like as a cleaning member. Examples of the material of the cleaning blade include a urethane rubber, a neoprene rubber, and a silicone rubber.

The static elimination device 214 is, for example, a device that irradiates the surface of the photoreceptor 207 after transfer with light to eliminate a residual potential of the photoreceptor 207. The static elimination device 214 may not be provided.

Figure 3:
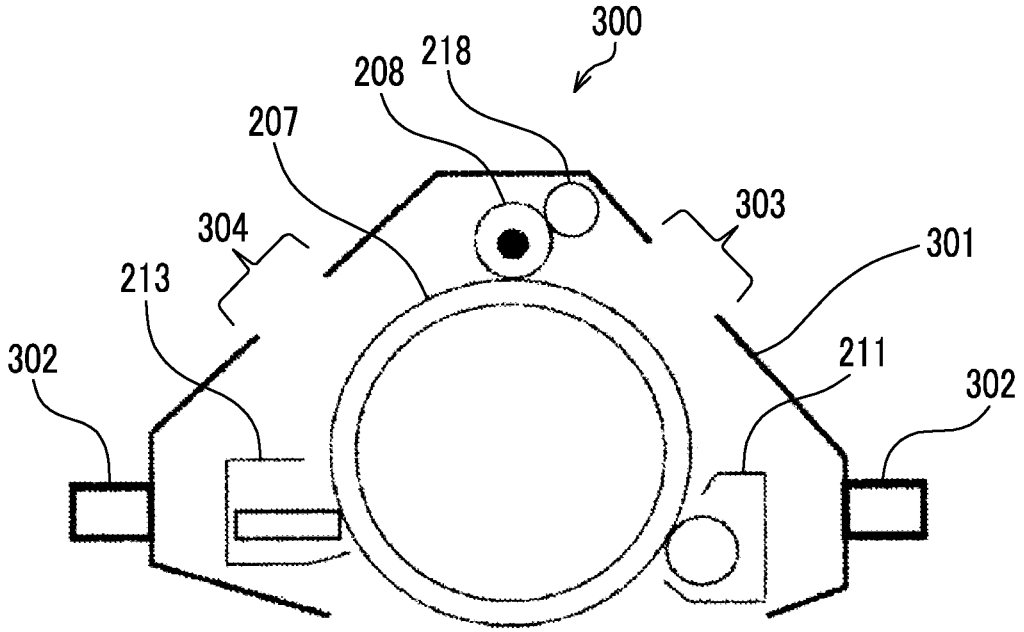
FIG. 3 is a schematic configuration diagram showing an example of a process cartridge according to the present exemplary embodiment.

FIG. 3 is a schematic diagram showing an example of a process cartridge according to the present exemplary embodiment. A process cartridge 300 shown in FIG. 3 is attached to and detached from, for example, an image forming apparatus main body including an exposure device, a transfer device, and a fixing device.

In the process cartridge 300, the photoreceptor 207, the charging member 208, the charging member cleaning member 218, the developing device 211, and the cleaning device 213 are integrated by the housing 301. The housing 301 is provided with a mounting rail 302 for attachment and detachment to and from an image forming apparatus, an opening 303 for exposure, and an opening 304 for a static elimination exposure.

Photoreceptor

Hereinafter, the details of the photoreceptor 207 will be described. The description will be made without reference numerals.

As the photoreceptor, a photoreceptor having a friction coefficient of a surface of 0.8 or less is applied.

The friction coefficient of the surface of the photoreceptor is, for example, preferably 0.8 or less. However, from the viewpoint of the drivenness of the charging member, a lower limit of the friction coefficient of the surface of the photoreceptor is, for example, 0.2 or more.

The friction coefficient of the surface of the photoreceptor is measured as follows.

The friction coefficient is measured 30 times continuously on the surface of the photoreceptor by a HEIDON resistance measuring method under the following measurement conditions, and an average of measured values from 10th to 20th times is calculated. For the friction coefficient, a dynamic friction coefficient of a needle is measured. For the measurement of the friction coefficient, TRIBOGEAR (overload fluctuation type friction wear test system) and TYPEHHS2000 (using standard analysis software) manufactured by Togaku Co., Ltd. are used.

Measurement Condition

Needle material: Diamond, Needle tip shape: R=0.2 mm, Overload: 20 g, Needle contact angle: 90° (in a direction perpendicular to the surface of the photoreceptor), Needle movement distance: Reciprocating at 10 mm one way, Number of reciprocating times: 30 times Examples of the photoreceptor having the friction coefficient of the surface of 0.8 or less include a photoreceptor having a conductive substrate, a photosensitive layer provided on the conductive substrate, and a protective layer provided on the photosensitive layer. A photoreceptor having a protective layer to impart wear resistance tends to have a low friction coefficient of the surface.

The photosensitive layer may be a laminated photosensitive layer in which a charge generating layer and a charge transporting layer are laminated, or may be a single-layer photosensitive layer.

An undercoat layer may be provided between the conductive substrate and the photosensitive layer. An intermediate layer may be further provided between the undercoat layer and the photosensitive layer.

Here, a ten-point average roughness Rz2 of the surface of the photoreceptor is, for example, preferably, 2 μm or less. By setting the surface texture of the photosensitive layer within the above range, driven failure of the charging member is further suppressed, and a streaky image defect is easily suppressed.

The ten-point average roughness Rz2 of the surface of the photoreceptor is, for example, more preferably 1.8 μm or less, and still more preferably 1.5 μm or less.

However, a lower limit of the ten-point average roughness Rz2 of the surface of the photoreceptor is, for example, preferably 0.3 μm or more, and more preferably 0.5 μm or more. This is because the adhesion of the toner and the external additive to the charging member due to an excessive increase in a contact area with the charging member is suppressed, and the occurrence of the streaky image defect is suppressed.

The ten-point average roughness Rz2 of the surface of the photosensitive layer can be adjusted by a film formation condition or polishing.

The ten-point average roughness Rz2 of the surface of the photosensitive layer can be measured by the same method as the ten-point average roughness Rz1 of the charging member that will be described later.

The details of each layer will be described below.

Conductive Substrate

Examples of the conductive substrate include metal plates containing a metal (such as aluminum, copper, zinc, chromium, nickel, molybdenum, vanadium, indium, gold, and platinum) or an alloy (such as stainless steel), a metal drum, a metal belt, and the like. In addition, examples of the conductive substrate include a paper, a resin film, a belt or the like coated, vapor-deposited, or laminated with a conductive compound (for example, a conductive polymer, indium oxide, and the like), a metal (for example, aluminum, palladium, gold, and the like) or an alloy.

As the conductive substrate, a well-known conductive substrate may be applied.

Undercoat Layer

Examples of the undercoat layer include a layer containing inorganic particles and a binder resin.

Examples of the inorganic particles include inorganic particles having a powder resistivity (volume resistivity) of $10^2\Omega\cdot$cm or more and $10^{11}\Omega\cdot$cm or less.

Among these, as the inorganic particles having the above resistance value, for example, metal oxide particles such as tin oxide particles, titanium oxide particles, zinc oxide particles, and zirconium oxide particles may be used. In particular, for example, zinc oxide particles are preferable.

The inorganic particles may be surface-treated. As the inorganic particles, two or more kinds thereof having different surface treatments or having different particle diameters may be mixed and used.

Examples of a surface treatment agent include a silane coupling agent, a titanate-based coupling agent, an aluminum-based coupling agent, a surfactant, and the like. For example, a silane coupling agent is particularly preferable, and a silane coupling agent having an amino group is more preferable.

Here, the undercoat layer may contain an electron-accepting compound (acceptor compound) together with the inorganic particles, for example, from a viewpoint of enhancing the long-term stability of electrical characteristics and a carrier blocking property.

As the electron-accepting compound, for example, a compound having an anthraquinone structure is preferable. As the compound having the anthraquinone structure, for example, a hydroxyanthraquinone compound, an aminoanthraquinone compound, an aminohydroxyanthraquinone compound, and the like are preferable. Specifically, for example, anthraquinone, alizarin, quinizarin, anthralphin, purpurin, and the like are preferable.

The electron-accepting compound may be dispersed and contained in the undercoat layer together with the inorganic particles, or may be contained in a state of adhering to the surface of the inorganic particles.

A content of the electron-accepting compound may be, for example, 0.01% by mass or more and 20% by mass or less, and preferably 0.01% by mass or more and 10% by mass or less with respect to the inorganic particles.

As the binder resin used for the undercoat layer, for example, a resin insoluble in the coating solvent of the upper layer is favorable. In particular, for example, thermosetting resins such as a urea resin, a phenol resin, a phenol-formaldehyde resin, a melamine resin, a urethane resin, an unsaturated polyester resin, an alkyd resin, and an epoxy resin and a resin obtained by reacting a curing agent with at least one resin selected from the group consisting of a polyamide resin, a polyester resin, a polyether resin, a methacrylic resin, an acrylic resin, a polyvinyl alcohol resin, and polyvinyl acetal resin is favorable.

In a case where two or more of these binder resins are used in combination, a mixing ratio thereof is set as necessary.

The undercoat layer may contain various additives for improving electrical characteristics, environmental stability, and image quality.

Examples of the additives include known materials such as electron-transporting pigments such as a polycyclic condensation-based electron-transporting pigment and an azo-based electron-transporting pigment, a zirconium chelate compound, a titanium chelate compound, an aluminum chelate compound, a titanium alkoxide compound, an organic titanium compound, and a silane coupling agent. The silane coupling agent is used for a surface treatment of the inorganic particles as described above, and may be further added to the undercoat layer as an additive.

A film thickness of the undercoat layer is set, for example, preferably in the range of 15 μm or more, and more preferably 20 μm or more and 50 μm or less.

Intermediate Layer

The intermediate layer is, for example, a layer containing a resin. Examples of the resin used for the intermediate layer include polymer compounds such as an acetal resin (for example, polyvinyl butyral and the like), a polyvinyl alcohol resin, a polyvinyl acetal resin, a casein resin, a polyamide resin, a cellulose resin, gelatin, a polyurethane resin, a polyester resin, a methacrylic resin, an acrylic resin, a polyvinyl chloride resin, a polyvinyl acetate resin, a vinyl chloride-vinyl acetate-maleic anhydride resin, a silicone resin, a silicone-alkyd resin, a phenol-formaldehyde resin, and a melamine resin.

The intermediate layer may be a layer containing an organometallic compound. Examples of the organometallic compound used for the intermediate layer include an organometallic compound containing a metal atom such as zirconium, titanium, aluminum, manganese, and silicon.

The compounds used for these intermediate layers may be used alone or as a mixture or a polycondensate of a plurality of compounds.

Among these, the intermediate layer is, for example, preferably a layer containing the organometallic compound containing a zirconium atom or a silicon atom.

The film thickness of the intermediate layer is, for example, preferably set in a range of 0.1 μm or more and 3 μm or less. The intermediate layer may be used as the undercoat layer.

Charge Generating Layer

The charge generating layer is, for example, a layer containing a charge generating material and a binder resin. In addition, the charge generating layer may be a vapor deposition layer of a charge generating material. The vapor deposition layer of the charge generating material is, for example, favorable in a case where a non-interfering light source such as a light emitting diode (LED) or an organic electro-luminescence (EL) image array is used.

Examples of the charge generating material include azo pigments such as bisazo and trisazo; condensed ring aromatic pigments such as dibromoanthhrone; perylene pigments; pyrrolopyrrole pigments; phthalocyanine pigments; zinc oxide; and trigonal selenium.

The binder resin used for the charge generating layer is selected from a wide range of insulating resins, and the binder resin may be selected from organic photoconductive polymers such as poly-N-vinylcarbazole, polyvinylanthracene, polyvinylpyrene, and polysilane.

A blending ratio of the charge generating material and the binder resin is, for example, preferably in a range of 10:1 to 1:10 in terms of mass ratio.

The charge generating layer may also contain other well-known additives.

A film thickness of the charge generating layer is set, for example, preferably in the range of 0.1 μm or more and 5.0 μm or less, and more preferably 0.2 μm or more and 2.0 μm or less.

Charge Transporting Layer

The charge transporting layer is, for example, a layer containing a charge transporting material and a binder resin. The charge transporting layer may be a layer containing a polymer charge transporting material.

Examples of the charge transporting material include electron-transporting compounds such as quinone-based compounds such as p-benzoquinone, chloranil, bromanil, and anthraquinone; tetracyanoquinodimethane-based compounds; fluorenone compounds such as 2,4,7-trinitrofluorenone; xanthone-based compounds; benzophenone-based compounds, cyanovinyl-based compounds, and ethylene-based compounds. Examples of the charge transporting material include hole transporting compounds such as triarylamine-based compounds, benzidine-based compounds, arylalkane-based compounds, aryl-substituted ethylene-based compounds, stylben-based compounds, anthracene-based compounds, and hydrazone-based compounds. One kind of these charge transporting materials is used alone or two or more kinds thereof are used in combination, but it is not limited thereto.

Examples of the binder resin used for the charge transporting layer include a polycarbonate resin, a polyester resin, a polyarylate resin, a methacrylic resin, an acrylic resin, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, a silicone resin, a silicone alkyd resin, a phenol-formaldehyde resin, a styrene-alkyd resin, a poly-N-vinylcarbazole, polysilane, and the like. Among these, as the binder resin, for example, a polycarbonate resin or a polyarylate resin is favorable. One kind of these binder resins is used alone or two or more kinds thereof are used in combination.

A blending ratio of the charge transporting material and the binder resin is, for example, preferably 10:1 to 1:5 in terms of mass ratio.

The charge transporting layer may also contain other well-known additives.

A film thickness of the charge transporting layer is set, for example, preferably within a range of 5 μm or more and 50 μm or less, and more preferably 10 μm or more and 30 μm or less.

Single-Layer Photosensitive Layer

The single-layer photosensitive layer (charge generation/charge transporting layer) is, for example, a layer containing a charge generating material and a charge transporting material, and, as necessary, a binder resin and other well-known additives. These materials are the same as the materials described in the charge generating layer and the charge transporting layer.

A content of the charge generating material in the single-layer photosensitive layer may be, for example, preferably 0.1% by mass or more and 10% by mass or less, and is preferably 0.8% by mass or more and 5% by mass or less with respect to the total solid content. Further, the content of the charge transporting material in the single-layer photosensitive layer may be, for example, 5% by mass or more and 50% by mass or less with respect to the total solid content.

A method of forming the single-layer photosensitive layer is the same as the method of forming the charge generating layer and the charge transporting layer.

A film thickness of the single-layer photosensitive layer may be, for example, 5 μm or more and 50 μm or less, and is preferably 10 μm or more and 40 μm or less.

Protective Layer

The protective layer is provided, for example, for the purpose of preventing a chemical change of the photosensitive layer at the time of charging and further improving a mechanical strength of the photosensitive layer.

The protective layer may be either an organic protective layer or an inorganic protective layer. However, the photoreceptor having the inorganic protective layer tends to have a low friction coefficient of the surface, and a streaky image defect is likely to occur due to driven failure of the charging member. However, by applying the charging member having the elastic layer having the storage elastic modulus G of 5.0 MPa or less at 100 Hz, driven failure of the charging member is suppressed even in a photoreceptor having an inorganic protective layer, and the occurrence of the streaky image defect is suppressed.

Organic Protective Layer

As the organic protective layer, for example, a layer configured of a cured film (crosslinked film) may be applied. Examples of the organic protective layer include layers shown in 1) or 2) below.

1) A layer configured of a cured film of a composition containing a reactive group-containing charge transporting material having a reactive group and a charge transporting skeleton in the same molecule (that is, a layer containing a polymer or a cross-linked body of the reactive group-containing charge-transporting material)

2) A layer configured of a cured film of a composition containing a non-reactive charge transporting material and a reactive group-containing non-charge transporting material having a reactive group and having no charge transporting skeleton (that is, a layer containing a non-reactive charge transporting material and a polymer or crosslinked body of the reactive group-containing non-charge transporting material)

The reactive group of the reactive group-containing charge transporting material include well-known reactive groups such as a chain polymerizable group, an epoxy group, —OH, —OR [where, R indicates an alkyl group], $—NH_2$, —SH, —COOH, and $—SiR^{Q1}{}_{3-Qn}(OR^{Q2})_{Qn}$ [where, $R^{Q1}$ represents a hydrogen atom, an alkyl group, or a substituted or unsubstituted aryl group, and $R^{Q2}$ represents a hydrogen atom, an alkyl group, or a trialkylsilyl group. Qn represents an integer of 1 to 3].

The chain-polymerizable group is not particularly limited as long as the group is a functional group capable of radical polymerization, and is, for example, a functional group having a group containing at least a carbon double bond. Specific examples thereof include a vinyl group, a vinyl ether group, a vinylthioether group, a styryl group (vinylphenyl group), an acryloyl group, a methacryloyl group, and a group containing at least one selected from derivatives thereof. Among these, the chain-polymerizable group is, for example, preferably the vinyl group, the styryl group (vinylphenyl group), the acryloyl group, the methacryloyl group, and a group containing at least one selected from derivatives thereof, in that reactivity thereof is excellent.

The charge transporting skeleton of the reactive group-containing charge transporting material is not particularly limited as long as the skeleton has a known structure in an electrophotographic photoreceptor, and examples thereof include a skeleton derived from a nitrogen-containing hole-transporting compound such as triarylamine-based compound, a benzidine-based compound, a hydrazone-based compound, or the like, as a structure coupled with a nitrogen atom. Among these, for example, a triarylamine skeleton is preferable.

The reactive group-containing charge transporting material having the reactive group and the charge transporting skeleton, the non-reactive charge transporting material, and the reactive group-containing non-charge transporting material may be selected from well-known materials.

The protective layer may also contain other well-known additives.

The formation of the protective layer is not particularly limited, and a well-known forming method is used. For example, a coating film of a coating liquid for forming a protective layer in which the above components are added to a solvent is formed, and the coating film is dried, and as necessary, cured by heating or the like.

Examples of the solvent for preparing the coating liquid for forming a protective layer include aromatic solvents such as toluene and xylene; ketone-based solvents such as methyl ethyl ketone, methyl isobutyl ketone, and cyclohexanone; ester-based solvents such as ethyl acetate and butyl acetate; ether-based solvent such as tetrahydrofuran and dioxane; cellosolve-based solvent such as ethylene glycol monomethyl ether; and alcohol-based solvent such as isopropyl alcohol and butanol. These solvents are used alone or two or more kinds thereof are used in combination.

The coating liquid for forming a protective layer may be a solvent-free coating liquid.

Examples of a method of applying the coating liquid for forming a protective layer onto a photosensitive layer (for example, a charge transporting layer) include ordinary methods such as a dip coating method, a push-up coating method, a wire bar coating method, a spray coating method, a blade coating method, a knife coating method, and a curtain coating method.

A film thickness of the protective layer is set, for example, preferably within a range of 1 μm or more and 20 μm or less, and more preferably 2 μm or more and 10 μm or less.

Inorganic Protective Layer

The inorganic protective layer is a layer formed by containing an inorganic material.

Examples of the inorganic material include oxide-based, nitride-based, carbon-based, and silicon-based inorganic materials from a viewpoint of having mechanical strength and translucency as a protective layer.

Examples of the oxide-based inorganic material include metal oxides such as a gallium oxide, an aluminum oxide, a zinc oxide, a titanium oxide, an indium oxide, a tin oxide, and a boron oxide, or mixed crystals thereof.

Examples of the nitride-based inorganic material include metal nitrides such as a gallium nitride, an aluminum nitride, a zinc nitride, a titanium nitride, an indium nitride, a tin nitride, and a boron nitride, or mixed crystals thereof.

Examples of the carbon-based and silicon-based inorganic materials include diamond-like carbon (DLC), amorphous carbon (a-C), hydrogenated amorphous carbon (a-C:H), hydrogen/fluorinated amorphous carbon (a-C:H), amorphous silicon carbide (a-SiC), hydrogenated amorphous silicon carbide (a-SiC:H), amorphous silicon (a-Si), hydrogenated amorphous silicon (a-Si:H), and the like.

The inorganic material may be a mixed crystal of oxide-based and nitride-based inorganic materials.

Among these, as the inorganic material, for example, the metal oxide, particularly an oxide of a Group 13 element, (desirably gallium oxide) is desirable, from the viewpoint of excellent mechanical strength and translucency, particularly n-type conductivity, and excellent conductivity controllability.

The inorganic protective layer contains a Group 13 element (for example, desirably gallium) and oxygen to increase water repellency. Due to this high water repellency, a cleaning property of the cleaning blade is improved.

From the above, the inorganic protective layer may be formed by containing, for example, at least a Group 13 element (particularly gallium) and oxygen, and may be formed of hydrogen, as necessary. By adding the hydrogen, it becomes easy to control the physical characteristics of the inorganic protective layer formed by containing at least Group 13 elements (particularly gallium) and oxygen. For example, in the inorganic protective layer containing gallium, oxygen, and hydrogen (for example, an inorganic protective layer formed of gallium oxide containing hydrogen), it becomes easier to control the volume resistivity in the range of $10^9\Omega\cdot$cm or more and $10^{14}\Omega\cdot$cm or less by changing a composition ratio [O]/[Ga] from 1.0 to 1.5.

In addition to the above-mentioned inorganic material, the inorganic protective layer may contain one or more elements selected from C, Si, Ge, and Sn in the case of n-type, for example, for controlling the conductive type. Further, for example, in a case of p-type, one or more elements selected from N, Be, Mg, Ca, and Sr may be contained.

Here, in a case where the inorganic protective layer is formed by containing gallium and oxygen and, as necessary, hydrogen, the elemental composition ratio is as follows, from the viewpoint of excellent mechanical strength, translucency, flexibility, and excellent conductivity controllability.

The elemental composition ratio of gallium may be, for example, 15 at % or more and 50 at % or less, is desirably 20 at % or more and 40 at % or less, and more desirably 20 at % or more and 30 at % or less, with respect to total constituent elements of the inorganic protective layer.

The elemental composition ratio of oxygen may be, for example, 30 at % or more and 70 at % or less, is desirably 40 at % or more and 60 at % or less, and more desirably 45 at % or more and 55 at % or less, with respect to total constituent elements of the inorganic protective layer.

The elemental composition ratio of hydrogen may be, for example, 10 at % or more and 40 at % or less, is desirably 15 at % or more and 35 at % or less, and more desirably 20 at % or more and 30 at % or less, with respect to total constituent elements of the inorganic protective layer.

On the other hand, the atomic number ratio [oxygen/gallium] may be, for example, more than 1.50 and 2.20 or less, and desirably 1.6 or more and 2.0 or less.

Here, the elemental composition ratio, the atomic number ratio, and the like of each element in the inorganic protective layer are obtained by Rutherford backscattering (hereinafter referred to as "RBS") including the distribution in a thickness direction. In RBS, 3SDH Pelletron manufactured by NEC is used as an accelerator, RBS-400 manufactured by CE & A is used as an end station, and 3S-R10 is used as a system. The HYPRA program or the like of CE & A is used for analysis.

Measurement conditions of RBS are that He++ ion beam energy is 2.275 eV, a detection angle is 160°, and a Grazing Angle is about 109° with respect to an incident beam.

Specifically, the RBS measurement is performed as follows. First, the He++ ion beam is incident perpendicular to a sample, a detector is set at 160° with respect to the ion beam, and a backscattered He signal is measured. A composition ratio and a film thickness are determined from the detected He energy and intensity. A spectrum may be measured at two detection angles in order to improve an accuracy of determining the composition ratio and the film thickness. The accuracy is improved by measuring and cross-checking at two detection angles with different depth direction resolution or backscattering mechanics.

The number of He atoms scattered backward by a target atom is determined only by three factors: 1) the atomic number of a target atom, 2) the energy of the He atom before scattering, and 3) the scattering angle.

A density is assumed by calculation from the measured composition, and the thickness is calculated using this assumption. A density error is within 20%.

The elemental composition ratio of hydrogen is determined by hydrogen forward scattering (hereinafter referred to as "HFS").

In HFS measurement, 3SDH Pelletron manufactured by NEC is used as an accelerator, RBS-400 manufactured by CE & A is used as an end station, and 3S-R10 is used as a system. The HYPRA program of CE & A is used for analysis. Moreover, the measurement conditions for HFS are as follows.

He++ ion beam energy: 2.275 eV

Detection angle: Grazing Angle 30° for an incident beam of 160°

The HFS measurement picks up a signal of hydrogen scattered in front of the sample by setting a detector at 30° to the He++ ion beam and the sample at 75° from the normal. For example, in this case, the detector may be covered with aluminum foil to remove He atoms scattered with hydrogen. Quantification is performed by standardizing hydrogen counts of a reference sample and a sample to be measured, by stopping power and then comparing the counts. As a sample for reference, a sample in which H is ion-implanted into Si and muscovite are used.

Muscovite is known to have a hydrogen concentration of 6.5 at %.

The H adsorbed on the outermost surface is corrected, for example, by subtracting the amount of H adsorbed on the clean Si surface.

Characteristics of Inorganic Protective Layer

The inorganic protective layer may have a composition ratio distribution in the thickness direction depending on the purpose, or may have a multi-layer structure.

The inorganic protective layer is, for example, desirably a non-single crystal film such as a microcrystalline film, a polycrystalline film, or an amorphous film. Among these, for example, amorphous is particularly desirable in terms of surface smoothness, and is more desirably a microcrystalline film in terms of hardness.

A growth cross section of the inorganic protective layer may have a columnar structure, and is for example, desirably a structure with high flatness from the viewpoint of slipperiness, and amorphous is desirable.

The crystallinity and amorphousness are determined by the presence or absence of points or lines in a diffraction image obtained by reflection high-energy electron diffraction (RHEED) measurement.

The volume resistivity of the inorganic protective layer is often, for example, $10^6\Omega\cdot$cm or more, and desirably $10^8\Omega\cdot$cm or more.

In a case where this volume resistivity is within the above range, the flow of electric charges in an in-plane direction is suppressed, and good electrostatic latent image formation is easily realized.

The volume resistivity is obtained by calculating from a resistance value measured under conditions of a frequency of 1 kHz and a voltage of 1 V using an LCR meter ZM2371 manufactured by nF Corporation, based on an electrode area and a sample thickness.

The measurement sample may be a sample obtained by forming a film on an aluminum substrate under the same conditions as in a case of forming the inorganic protective layer to be measured, and forming a gold electrode on the film by vacuum deposition. Alternatively, the measurement sample may be a sample in which the inorganic protective layer is peeled off from the electrophotographic photoreceptor after production, partially etched, and sandwiched between a pair of electrodes.

An elastic modulus of the inorganic protective layer may be, for example, 30 GPa or more and 80 GPa or less, and is desirably 40 GPa or more and 65 GPa or less.

In a case where the elastic modulus is within the above range, the formation of the unevenness, peeling, and cracking of recesses in the inorganic protective layer are likely to be suppressed.

A depth profile by a continuous rigidity method (CSM) (US4,848,141A) is obtained using Nano Indenter SA2 manufactured by MTS Systems, an average value obtained from the measured values in the indentation depth of 30 nm to 100 nm is used as the elastic modulus.

The following are measurement conditions.

Measurement environment: 23° C., 55% RH

Indenter used: Diamond regular triangular pyramid indenter (Berkovic indenter) triangular pyramid indenter Test mode: CSM mode The measurement sample may be a sample formed on the substrate under the same conditions in a case where the inorganic protective layer to be measured is formed, or the inorganic protective layer is peeled off from the electrophotographic photoreceptor after production, a partially etched sample may be used.

The film thickness of the inorganic protective layer may be, for example, 0.2 μm or more and 10.0 μm or less, and is desirably 0.4 μm or more and 5.0 μm or less.

In a case where the film thickness is within the above range, the formation of the unevenness, peeling, and cracking of recesses in the inorganic protective layer are likely to be suppressed.

Formation of Inorganic Protective Layer

For the formation of the protective layer, for example, known vapor deposition methods such as a plasma Chemical Vapor Deposition (CVD) method, a metalorganic vapor phase growth method, a molecular beam epitaxy method, a deposition, and sputtering are used.

Charging Device

Hereinafter, the charging device will be described. The description will be made without reference numerals.

The charging device includes, for example, a charging member that charges the surface of the photoreceptor, a power supply connected to the charging member (an example of an application unit), and a charging member cleaning member that cleans the outer peripheral surface of the charging member.

A charging member includes a conductive base material, an elastic layer that is provided on the conductive base material, and has a storage elastic modulus G of 5.0 MPa or less at 100 Hz, and a surface layer that is provided on the elastic layer.

The storage elastic modulus G of the elastic layer at 100 Hz is 5.0 MPa or less, and is, for example, preferably 4.0

MPa or less, and still more preferably 3.0 MPa or less, from the viewpoint of suppressing a streaky image defect due to driven failure of the charging member.

On the other hand, from the viewpoint of suppressing dot-like image omission (for example, white spots), the storage elastic modulus G is, for example, preferably 1.0 MPa or more, more preferably 1.5 MPa or more, and still more preferably 2.0 MPa.

The storage elastic modulus G is, for example, preferably 1.0 MPa or more and 5.0 MPa or less, more preferably 1.5 MPa or more and 4.0 MPa or less, and still more preferably 2.0 MPa or more and 3.0 MPa or less.

The storage elastic modulus G of the elastic layer is measured as follows.

The elastic layer is cut out from the charging member that is an object of measurement to have a length of 24 mm, a width of 2 mm, and a thickness of 0.5 mm and the storage elastic modulus thereof at 100 Hz is measured by using a dynamic viscoelastometer RHEOVIBRON (manufactured by ORIENTEC Co., LTD), under conditions of a temperature of 24° C., a distance between chucks of 20 mm, a load of 10 gf, an amplitude of 80 μm, and an automatic sweep from a frequency of 0.1 Hz to 100 Hz.

Furthermore, in the charging member, in a Cole-Cole plot obtained by measuring the charging member in a range of 1 MHz to 0.1 Hz by an alternating current impedance method, a resistance component Ra of a capacitive semicircle including 2.5 kHz is, for example, preferably $6.3\times10^4\Omega$ or less.

Here, in an image forming apparatus using a charging device using a contact charging method, a surface of an electrophotographic photoreceptor is charged by discharging in a minute gap (also referred to as a "micro gap") around a contact portion between the electrophotographic photoreceptor and the charging member. In a case where the discharge load is large, the amount of the discharge product adhered increases, and a streaky image defect is likely to occur.

On the other hand, in a case where a voltage applied to the charging member is lowered, the load due to the discharging is reduced, but the voltage applied to a discharge region becomes weak and non-uniform. Accordingly, a dot-like image omission due to uneven charging may occur in an image. Therefore, for example, it is preferable that a voltage required to suppress the occurrence of the dot-like image omission is applied to the charging member.

On the other hand, in a case where the storage elastic modulus G of the elastic layer is 5.0 MPa or less and the resistance component Ra is $6.3\times10^4\Omega$ or less, the amount of the discharge product adhered is reduced and a streaky image defect is easily suppressed. The reason is presumed as follows.

Here, the resistance component Ra is a resistance component of a capacitive semicircle including 2.5 kHz, in the Cole-Cole plot obtained by measuring the charging member in a range of 1 MHz to 0.1 Hz by an alternating current impedance method. In the Cole-Cole plot obtained by measuring the charging member having the conductive base material, the elastic layer, and the surface layer, it is considered that the capacitive semicircle including 2.5 kHz is derived from the elastic layer. Moreover, by lowering the resistance component Ra of the capacitive semicircle derived from the elastic layer, a proportion of a voltage, which is consumed by the elastic layer of the charging member, to the voltage applied to the charging member is reduced. Therefore, even in a case where the alternating current voltage applied to the charging member is reduced, the dot-like image omission is less likely to occur. That is, the alternating current voltage required to suppress the occurrence of the dot-like image omission is lowered. Therefore, by applying a low alternating current voltage to the charging member to form an image, a discharge load applied to the electrophotographic photoreceptor is reduced.

In addition, the storage elastic modulus G is a storage elastic modulus of the elastic layer at 100 Hz. In the image forming apparatus, the charging member operates at a high rotation speed of 100 Hz or higher in general. That is, the expression that the storage elastic modulus G is low means that the storage elastic modulus of the elastic layer in the charging member that operates at the high rotation speed of 100 Hz or higher is low. Moreover, it is considered that, in a case where the storage elastic modulus G is low, in a contact portion between the charging member and the electrophotographic photoreceptor, the electrophotographic photoreceptor bites into the charging member, a contact width becomes long, an angle at which the surface of the charging member separates from the electrophotographic photoreceptor becomes steep, and a width which becomes a minute gap becomes narrower. That is, a discharge width becomes narrow. Therefore, the discharge load applied to the electrophotographic photoreceptor is reduced.

As described above, it is presumed that, since the storage elastic modulus G is 5.0 MPa or less and the resistance component Ra is $6.3\times10^4\Omega$ or less, the discharge load to the electrophotographic photoreceptor is reduced, therefore, the amount of discharge product adhered is reduced, and a streaky image defect is easily suppressed.

In the Cole-Cole plot obtained by measuring the charging member by the alternating current impedance method, the resistance component Ra of the capacitive semicircle including 2.5 kHz is $6.3\times10^4\Omega$ or less, and from the viewpoint of suppressing the streaky image defect, is for example, preferably $5.0\times10^4\Omega$ or less and more preferably $4.0\times10^4\Omega$ or less.

From a viewpoint of suppressing a decrease in chargeability due to current flowing at the contact portion between the charging member and the photoreceptor, the resistance component Ra is, for example, preferably $1.0\times10^4\Omega$ or more, more preferably $1.5\times10^4\Omega$ or more, and still more preferably $2.0\times10^4\Omega$ or more.

The resistance component Ra is measured as follows.

In the measurement by the alternating current impedance method, SI 1260 inpedance/gain phase analyzer (manufactured by TOYO Corporation) is used as a power supply and an ammeter and 1296 dielectric interface (manufactured by TOYO Corporation) is used as a current amplifier.

An alternating current voltage of 1 Vp-p is applied from a high frequency side in a frequency range of 1 MHz to 0.1 Hz, by using the conductive base material of the charging member, that is an object of the impedance measurement, as a cathode and the outer peripheral surface of the charging member, around which an aluminum plate with a width of 1.5 cm is wound, as an anode, and an alternating current impedance of the charging member that is an object of measurement is measured. In a graph of the Cole-Cole plot obtained from the measurement, by fitting the capacitive semicircle including 2.5 kHz to an RC parallel equivalent circuit, the resistance component Ra (unit: Ω) and a capacitance component Ca (unit: F) is obtained.

Examples of a method of controlling the resistance component Ra and the storage elastic modulus G within the above ranges include a method of controlling by adjusting a blending ratio of a component to be contained in the elastic layer, a method of controlling by changing a manufacture condition (for example, a cross-linking condition and the like) of the elastic layer.

Specifically, for example, in a case where the elastic layer contains an inorganic filler such as calcium carbonate, the resistance component Ra and the storage elastic modulus G may be controlled by adjusting a content of the inorganic filler. By lowering the content of the inorganic filler, a value of the resistance component Ra tends to decrease, and a value of the storage elastic modulus G also tends to decrease.

In addition, for example, in a case where the elastic layer contains carbon black, the resistance component Ra and the storage elastic modulus G may be controlled by adjusting the content of carbon black. By lowering the content of the carbon black, the value of the resistance component Ra tends to decrease, and the value of the storage elastic modulus G also tends to decrease.

Also, for example, in a case where the elastic layer contains an epichlorohydrin-alkylene oxide copolymer rubber, the resistance component Ra may be controlled by adjusting a polymerization ratio of the copolymer rubber. By increasing the polymerization ratio of an alkylene oxide component in the copolymer rubber, the value of the resistance component Ra tends to decrease.

Further, for example, in a case where the elastic layer is obtained through a cross-linking reaction, the resistance component Ra may be controlled by reducing the amount of a cross-linking agent, lowering a heating temperature at the time of cross-linking, shortening heating time at the time of cross-linking, and the like.

The details of charging member will be described below.

In a case where the charging member includes the conductive base material, the elastic layer that is formed on the conductive base material, and the surface layer that is provided on the elastic layer, a layer configuration thereof is not particularly limited, and may further include other layers. Examples of other layers include one or more adhesive layers provided between the conductive base material and the elastic layer, one or more intermediate layers provided between the elastic layer and the surface layer, and the like.

A shape of the charging member according to the present exemplary embodiment is not particularly limited, and for example, a form of a roll-shaped charging member, that is, a so-called charging roll is preferable.

Hereinafter, each configuration of the charging member will be largely described.

Conductive Base Material

The conductive base material functions as an electrode and a support of the charging member.

As the conductive base material, for example, metals or alloys such as aluminum, a copper alloy, and stainless steel; iron plated with chromium, nickel, and the like; and a base material formed of a conductive material such as a conductive resin are used. The conductive base material in the present exemplary embodiment functions as an electrode and a support member of the charging roll. Examples of a material thereof include metals such as iron (such as free-cutting steel), copper, brass, stainless steel, aluminum, and nickel. In the present exemplary embodiment, the conductive base material is a conductive rod-shaped member. Examples of the conductive base material include a member (for example, a resin or a ceramic member) whose outer peripheral surface is plated, and a member (for example, a resin or a ceramic member) in which a conductive agent is dispersed, and the like. The conductive base material may be a hollow member (cylindrical member) or a non-hollow member.

Elastic Layer

Examples of the elastic layer include a conductive layer containing an elastic material and a conductive agent. The elastic layer may contain an inorganic filler and other additives, as needed.

The elastic layer may be a single layer or a laminated body in which plural layers are laminated. The elastic layer may be a conductive foamed elastic layer, a conductive non-foamed elastic layer, or a laminate of a conductive foamed elastic layer and a conductive non-foamed elastic layer.

Elastic Material

Examples of the elastic material include an epichlorohydrin-based rubber, polyurethane, a nitrile rubber, an isoprene rubber, a butadiene rubber, an ethylene-propylene rubber, an ethylene-propylene-diene rubber, a styrene-butadiene rubber, an acrylonitrile-butadiene rubber, a chloroprene rubber, chlorinated polyisoprene, hydrogenated polybutadiene, a butyl rubber, a silicone rubber, a fluoro-rubber, a natural rubber, and an elastic material in which these materials are mixed. Among these elastic materials, for example, the epichlorohydrin-based rubber, the acrylonitrile-butadiene rubber, the styrene-butadiene rubber, the chloroprene rubber, the polyurethane, the silicone rubber, the nitrile rubber, the ethylene-propylene-diene rubber, and an elastic material in which these materials are mixed are preferable.

Among these elastic materials, for example, the elastic layer preferably contains at least the epichlorohydrin-based rubber, from a viewpoint of resistance uniformity.

The epichlorohydrin-based rubber is a polymer rubber containing at least a structural unit derived from epichlorohydrin (hereinafter, also referred to as "epichlorohydrin component"). Examples of the epichlorohydrin-based rubber include a homopolymer and a multiple copolymer (such as a binary copolymer, a ternary copolymer) of epichlorohydrin. Examples of the multiple copolymer include an epichlorohydrin-allyl glycidyl ether copolymer rubber, an epichlorohydrin-alkylene oxide (ethylene oxide, propylene oxide, or both thereof) copolymer rubber, and the like.

For example, the elastic layer preferably contains a polymorphic copolymer containing an epichlorohydrin component, and more preferably contains an epichlorohydrin-alkylene oxide copolymer rubber from a viewpoint that it becomes easy to control the resistance component Ra.

The epichlorohydrin-alkylene oxide copolymer rubber may contain an epichlorohydrin component and a structural unit derived from the alkylene oxide (hereinafter, also referred to as "alkylene oxide component"), and may further contain a structural unit derived from other polymerization components. Examples of other polymerization components include allyl glycidyl ether and the like. The epichlorohydrin-alkylene oxide copolymer rubber may be an epichlorohydrin-alkylene oxide rubber consisting of an epichlorohydrin component and an alkylene oxide component, and may be an epichlorohydrin-alkylene oxide-allyl glycidyl ether rubber containing an epichlorohydrin component, an alkylene oxide component, and a structural unit derived from allyl glycidyl ether.

In a case where the elastic layer contains the epichlorohydrin-alkylene oxide copolymer rubber, a content of the alkylene oxide component with respect to the entire epichlorohydrin-alkylene oxide copolymer rubber is, for example, preferably 45% by mass or more, more preferably 50% by mass or more and 70% by mass or less, and still more preferably 55% by mass or more and 65% by mass or less. In a case where the content of the alkylene oxide component is in the above range, it becomes easier to control the resistance component Ra to a lower value, compared to a case where the content is less than the above range. In addition, in a case where the content of the alkylene oxide component is in the above range, it is good that the resistance component Ra can be easily controlled to a low value and a resistance fluctuation due to an environment (temperature and humidity) is small, compared to a case where the content is more than the above range.

A proportion of the epichlorohydrin-based rubber to the entire elastic material contained in the elastic layer is, for example, preferably 80% by mass or more, more preferably 90% by mass or more, and still more preferably 95% by mass or more, from the viewpoint of resistance uniformity.

Conductive Agent

Examples of the conductive agent include an electronic conductive agent and an ionic conductive agent.

Examples of the electronic conductive agent include powers of carbon black such as furnace black, thermal black, channel black, ketjenblack, acetylene black, and color black; pyrolytic carbon; graphite; a metal or an alloy such as aluminum, copper, nickel, and stainless steel; a metal oxide such as a tin oxide, an indium oxide, a titanium oxide, a tin oxide-antimony oxide solid solution, tin oxide-indium oxide solid solution; a substance in which a surface of an insulating material is subjected to a conduction treatment; and the like.

Examples of the ionic conductive agent include a perchlorate or a chlorate such as tetraethylammonium, lauryltrimethylammonium, and benzyltrialkylammonium; a perchlorate or a chlorate of alkali metals such as lithium and magnesium or alkaline earth metals; and the like.

One kind of the conductive agent may be used alone, or two or more kinds thereof may be used in combination.

Among these conductive agents, for example, the elastic layer preferably contains at least carbon black from a viewpoint of formability, and for example, preferably contains carbon black and an ionic conductive agent from the viewpoint of suppressing the resistance fluctuation due to the environment (temperature and humidity) while controlling the resistance component Ra and the storage elastic modulus G.

From viewpoints of resistance controllability and a kneadability, an arithmetic average particle diameter of the carbon black is, for example, preferably 1 nm or more and 200 nm or less, more preferably 10 nm or more and 200 nm or less, still more preferably 10 nm or more and 100 nm or less, and particularly preferably 30 nm or more and 70 nm or less.

The arithmetic average particle diameter of the carbon black is a number average particle size obtained by measuring a particle size distribution using a laser diffraction type particle size distribution measuring device (for example, LS13 320 manufactured by Beckman Coulter). In the obtained particle size distribution, a cumulative distribution is subtracted from a small particle size side of each peak for a divided particle size range (channel), and a particle size of 50% cumulative for all particles of each peak is set to the arithmetic average particle diameter of corresponding particles.

The arithmetic average particle diameter of the carbon black may be calculated using a sample obtained by cutting out an elastic layer by observing with an electron microscope, measuring diameters (maximum diameters) of 100 particles of the conductive agent, and averaging the diameters. In addition, the arithmetic average particle diameter may be measured using, for example, a Zetasizer Nano ZS manufactured by Sysmex Corporation.

In a case where the elastic layer contains the carbon black, the content of the carbon black is, for example, preferably 10 parts by mass or less, more preferably 5 parts by mass or less, and still more preferably 3 parts by mass or less, with respect to 100 parts by mass of the elastic material, from the viewpoint of controlling the resistance component Ra and the storage elastic modulus G within the above ranges. In addition, the content of the carbon black is, for example, preferably 1 part by mass or more with respect to 100 parts by mass of the elastic material from the viewpoint of formability.

The content of the carbon black is, for example, preferably 10 parts by mass or less, more preferably 1 part by mass or more and 5 parts by mass or less, and still more preferably 1 part by mass or more and 3 parts by mass or less, with respect to 100 parts by mass of the elastic material.

The ionic conductive agent contained in the elastic layer is, for example, preferably at least one compound selected from the group consisting of a quaternary ammonium salt compound, an alkali metal or an alkaline earth metal salt of perchloric acid, and an alkali metal or an alkaline earth metal salt of chloric acid, and more preferably the quaternary ammonium salt compound, from a viewpoint of long-term image quality maintenance regardless of environment.

In a case where the elastic layer contains the ionic conductive agent, a content of the ionic conductive agent is, for example, preferably 0.1 parts by mass or more and 5 parts by mass or less, more preferably 0.5 parts by mass or more and 3 parts by mass or less, and still more preferably 1 part by mass or more and 2 parts by mass or less, with respect to 100 parts by mass of the elastic material, from viewpoints of resistance controllability and bleeding suppression.

In a case where the elastic layer contains the carbon black and the ionic conductive agent, a content of the carbon black is, for example, preferably 0.1 times or more and 10 times or less the content of the ionic conductive agent, more preferably 0.3 times or more and 5 times or less, and still more preferably 0.5 times or more and 2 times or less.

Inorganic Filler

The elastic layer may contain an inorganic filler, as necessary. In a case where the elastic layer contains the inorganic filler, it is good that the formability is improved.

Examples of the inorganic filler include calcium carbonate, silica, clay minerals, and the like. Among these, for example, the calcium carbonate is preferable, from the viewpoint of formability and kneadability.

A content of the inorganic filler is, for example, preferably 40 parts by mass or less, more preferably 35 parts by mass or less, and still more preferably 30 parts by mass or less, with respect to 100 parts by mass of the elastic material, from the viewpoint of controlling the resistance component Ra and the storage elastic modulus G within the above ranges. From the viewpoint of formability, the content of the inorganic filler is, for example, preferably 5 parts by mass or more, more preferably 10 parts by mass or more, and still more preferably 15 parts by mass or more, with respect to 100 parts by mass of the elastic material.

The content of the inorganic filler is, for example, preferably 5 parts by mass or more and 40 parts by mass or less, more preferably 10 parts by mass or more and 35 parts by mass or less, and still more preferably 15 parts by mass or more and 30 parts by mass or less, with respect to 100 parts by mass of the elastic material.

Other Additives

The elastic layer may contain other additives, as needed.

Examples of other additives to be blended in the elastic layer include a softeners, a plasticizer, a curing agent, a vulcanizing agent, a vulcanization accelerator, a vulcanization accelerating aid, an antioxidant, a surfactant, a coupling agent, and the like.

Characteristics of Elastic Layer

A thickness of the elastic layer is, for example, preferably 1 mm or more and 10 mm or less, and more preferably 2 mm or more and 5 mm or less.

A volume resistivity of the elastic layer is, for example, preferably $1\times10^{3}\Omega\cdot$cm or more and $1\times10^{14}\Omega\cdot$cm or less.

The volume resistivity of the elastic layer is a value measured by a method shown below.

A sheet-shaped measurement sample is collected from the elastic layer. A voltage adjusted so that an electric field (applied voltage/composition sheet thickness) is 1000 V/cm is applied to the measurement sample for 30 seconds by using a measuring jig (R12702A/B resistivity chamber: manufactured by Advantest Corporation) and a high resistance meter (R8340A digital high resistance/micro ammeter: manufactured by Advantest Corporation) in accordance with JIS K 6911 (1995), and then the volume resistivity is calculated from a flowing current value by using the following Equation.

$$\text{Volume resistivity}(\Omega\cdot\text{cm})=(19.63\times\text{Applied voltage}(V))/(\text{Current value}(A)\times\text{Measurement sample thickness(cm)})$$

Formation of Elastic Layer

Examples of a method of forming the elastic layer on the conductive base material include a method in which a composition for forming an elastic layer in which the elastic material and a conductive agent are mixed with an inorganic filler and other additives used as necessary, and a cylindrical conductive base material are both extruded from an extruder, a layer of the composition for forming an elastic layer is formed on an outer peripheral surface of the conductive base material, and then the layer of the composition for forming an elastic layer is heated and subjected to a cross-linking reaction to form an elastic layer; a method in which a composition for forming an elastic layer in which an elastic material and a conductive agent are mixed with an inorganic filler and other additives used as necessary is extruded from an extruder to an outer peripheral surface of an endless belt-shaped conductive base material, a layer of the composition for forming an elastic layer is formed on the outer peripheral surface of the conductive base material, and then the layer of the composition for forming an elastic layer is heated and subjected to a cross-linking reaction to form an elastic layer; and the like. The conductive base material may have an adhesive layer on an outer peripheral surface thereof.

In a case where the cross-linking reaction is performed in a formation of the elastic layer, a cross-linking agent, a cross-linking accelerator, and a vulcanization-promoting auxiliary agent may further be applied, in addition to the elastic material, the conductive agent, and the inorganic filler and other additives used as necessary.

Generally, examples of a kind of cross-linking using a cross-linking agent include sulfur cross-linking, peroxide cross-linking, quinoid cross-linking, phenol resin cross-linking, amine cross-linking, metal oxide cross-linking, and the like, and cross-linking with a material having a double bond, for example, the cross-linking with sulfur is preferable from the viewpoint of ease of cross-linking and flexibility of a cross-linked rubber.

Examples of the cross-linking accelerator include thiazole-based, thiuram-based, sulfenamide-based, thiourea-based, dithiocarbamate-based, guanidine-based, aldehyde-ammonia-based, and a mixture thereof.

Examples of the cross-linking accelerator include a zinc oxide and the like.

Further, in a case where the cross-linking reaction is performed in the formation of the elastic layer, from the viewpoint of controlling the resistance component Ra within the above range, conditions may be adjusted, such as reducing the amount of the cross-linking agent, lowering the heating temperature at the time of cross-linking, and shortening heating time at the time of cross-linking.

Surface Layer

Examples of the surface layer include a layer containing a binder resin. The surface layer may contain conductive particles that control the resistivity of the surface layer, particles for forming unevenness that control the unevenness of the outer peripheral surface, and other additives.

Binder Resin

Examples of the binder resin include an acrylic resin, a fluorine-modified acrylic resin, a silicone-modified acrylic resin, a cellulose resin, a polyamide resin, copolymerized nylon, a polyurethane resin, a polycarbonate resin, a polyester resin, a polyimide resin, an epoxy resin, a silicone resin, a polyvinyl alcohol resin, a polyvinyl butyral resin, a polyvinyl acetal resin, an ethylene tetrafluoroethylene resin, a melamine resin, a polyethylene resin, a polyvinyl resin, a polyarylate resin, a polythiophene resin, a polyethylene terephthalate resin (PET), and fluororesin (such as a polyfluorovinylidene resin, a tetrafluoroethylene resin, a tetrafluoroethylene-perfluoroalkyl vinyl ether copolymer (PFA), and a tetrafluoroethylene-hexafluoropropylene copolymer (FEP)). In addition, examples of the binder resin include a curable resin cured or crosslinked with a curing agent or a catalyst. Also, the binder resin may be an elastic material.

The binder resin may be used alone or two or more kinds thereof may be used by being mixed or copolymerized. In a case where the binder resin is a crosslinkable resin, the crosslinkable resin may be crosslinked and used.

Here, the copolymerized nylon is a copolymer containing any one or more of 610 nylon, 11 nylon, and 12 nylon, as a polymerization unit. The copolymerized nylon may contain other polymerization units such as 6 nylon and 66 nylon.

Among these, from a viewpoint of durability, the binder resin is, for example, preferably a polyvinylidene fluoride resin, an ethylene tetrafluoride resin, or a polyamide resin, and more preferably polyamide resin. The polyamide resin is less likely to cause triboelectric charging due to contact with a charging body (for example, an image holder), and adhesion of toner or an external additive is likely to be suppressed.

Examples of the polyamide resin include the polyamide resins described in the Polyamide Resin Handbook (Osamu Fukumoto, Nikkan Kogyo Shimbun). Among these, in particular, as the polyamide resin, for example, alcohol-soluble polyamide is preferable, alkoxymethylated polyamide (alkoxymethylated nylon) is more preferable, and methoxymethylated polyamide (methoxymethylated nylon) is still more preferable, from the viewpoint of suppressing contamination of the surface layer and suppressing uneven charging.

The number average molecular weight of the binder resin (a polymer material) is, for example, preferably in the range of 1,000 or more and 100,000 or less, and more preferably in the range of 10,000 or more and 50,000 or less.

Conductive Particle

Examples of the conductive particles contained in the surface layer include particles having a particle size of 3 μm or less and a volume resistivity of $10^9\Omega\cdot$cm or less, and specifically, metal oxides such as a tin oxide, a titanium oxide, and a zinc oxide. Alternatively, particles made of these alloys, carbon black, or the like can be mentioned. Among these, for example, the carbon black is preferable as the conductive particles from the viewpoint of resistance controllability. One kind of the conductive particles may be used alone, or two or more kinds thereof may be used in combination.

In a case where the surface layer contains the conductive particles, examples of a content of the conductive particles include a range of 3 parts by mass or more and 25 parts by mass or less, with respect to 100 parts by mass of the binder resin. From the viewpoint of controlling the "resistance value Rd obtained by measuring the charging member by the direct current method" which will be described later, the content of the conductive particles is, for example, preferably 5 parts by mass or more and 20 parts by mass or less, and more preferably 10 parts by mass or more and 15 parts by mass or less.

Particles for Forming Unevenness

The material of the particles for forming unevenness contained in the surface layer is not particularly limited, and may be inorganic particles or organic particles.

Specific examples of the particles for forming unevenness contained in the surface layer include inorganic particles such as silica particles, alumina particles, and zircon ($ZrSiO_4$) particles, and resin particles such as polyamide particles, fluororesin particles, and silicone resin particles.

Among these, for example, the particles for forming unevenness contained in the surface layer are more preferably resin particles and still more preferably polyamide particles, from the viewpoint of dispersibility and durability.

One kind alone or two or more kinds of the particles for forming unevenness may be contained in the surface layer.

In a case where the surface layer contains the particles for forming unevenness, from the viewpoint of controlling the "ten-point average roughness Rz1 on the outer peripheral surface of the charging member" and the "average spacing Sm of the unevenness on the outer peripheral surface of the charging member" which will be described later, as the particles for forming unevenness, for example, the particles for forming unevenness having a volume average particle diameter of 5 μm or more and 20 μm or less are preferably contained in an amount of 5 parts by mass or more and 30 parts by mass or less with respect to 100 parts by mass of the binder resin. Further, for example, the particles for forming unevenness having a volume average particle diameter of 5 μm or more and 10 μm or less are more preferably contained in an amount of 8 parts by mass or more and 20 parts by mass or less with respect to 100 parts by mass of the binder resin.

Regarding a method of measuring the volume average particle diameter of the particles for forming unevenness, the volume average particle diameter is calculated by observing with an electron microscope using a sample from which the layer has been cut out, measuring the diameters (maximum diameters) of 100 particles, and averaging the diameters. Further, the average particle diameter may be measured using, for example, a Zetasizer Nano ZS manufactured by Sysmex Corporation.

Other Additives

The surface layer may contain other additives. Examples of other additives include well-known additives such as a curing agent, a vulcanizing agent, a vulcanization accelerator, an antioxidant, a dispersant, a surfactant, and a coupling agent.

Characteristics of Surface Layer

The thickness of the surface layer is, for example, preferably 1 μm or more and 20 μm or less, more preferably 3 μm or more and 15 μm or less, and still more preferably 5 μm or more and 13 μm or less.

In a case where the thickness of the surface layer is not uniform (for example, in a case where the outer peripheral surface of the surface layer has unevenness), the thickness means a thickness of a recessed portion of the unevenness, that is, a binder resin portion containing no unevenness forming particles.

A volume resistivity of the surface layer is, for example, preferably $1\times10^5\Omega\cdot$cm or more and $1\times10^8\Omega\cdot$cm or less.

Formation of Surface Layer

The surface layer is formed by dispersing or dissolving the above-mentioned components in a solvent to prepare a coating liquid, applying the coating liquid on the elastic layer prepared in advance, and drying the surface layer. Examples of a method of applying the coating liquid include a roll coating method, a blade coating method, a wire bar coating method, a spray coating method, a dip coating method, a bead coating method, an air knife coating method, a curtain coating method, and the like.

The solvent used for the coating liquid is not particularly limited, and general solvents are used. For example, alcohols such as methanol, ethanol, propanol, and butanol; ketones such as acetone and methyl ethyl ketone; tetrahydrofuran; ethers such as diethyl ether, dioxane may be used.

In a case where the surface layer contains the conductive particles, from the viewpoint of controlling the "resistance value Rd obtained by measuring the charging member by the direct current method" which will be described later, for example, it is preferable that a dipping method is used as the method of applying the coating liquid and a dispersed state of the conductive particles is adjusted by changing a solvent volatilization rate according to a dew point at the time of air drying immediately after coating, a wind speed setting, and the like.

Adhesive Layer

The charging member may have an adhesive layer between the conductive base material and the elastic layer.

Examples of the adhesive layer interposed between the elastic layer and the conductive base material include a resin layer. Specific examples of the adhesive layer include resin layers of polyolefin, an acrylic resin, an epoxy resin, polyurethane, a nitrile rubber, a chlorine rubber, a vinyl chloride resin, a vinyl acetate resin, a polyester resin, a phenol resin, and a silicone resin. The adhesive layer may contain a conductive agent (for example, the above-mentioned electronic conductive agent or the ionic conductive agent).

From the viewpoint of adhesion, a thickness of the adhesive layer is, for example, preferably 1 μm or more and 100 μm or less, more preferably 2 μm or more and 50 μm or less, and particularly preferably 5 μm or more and 20 μm or less.

Characteristics of Charging Member

For example, it is preferable that the ten-point average roughness Rz1 on the outer peripheral surface of the charging member is 8 μm or less, and the average spacing Sm of the unevenness is 100 μm or more.

The driven failure of the charging member is further suppressed by setting the surface textures of the charging member within the above ranges. In addition, foreign matters such as toner and external additives are less likely to adhere to the outer peripheral surface of the charging member, and contamination of the charging member is suppressed. Therefore, a streaky image defect is easily suppressed.

However, from the viewpoint of suppressing the adhesion of the toner and the external additive to the charging member due to the excessive increase in the contact area with the photoreceptor and suppressing the occurrence of a streaky image defect, for example, in the outer peripheral surface of the charging member, is preferable that the ten-point average roughness Rz1 is 2 μm or more and the average spacing Sm of the unevenness is 400 μm or less.

However, a lower limit of the ten-point average roughness Rz1 of the outer peripheral surface of the charging member is, for example, preferably 2 μm or more, and more preferably 4 μm or more.

However, an upper limit of the ten-point average roughness Rz1 in the outer peripheral surface of the charging member is, for example, preferably 7.5 μm or less, and still more preferably 5 μm or less.

A lower limit of the average spacing Sm of the unevenness on the outer peripheral surface of the charging member is, for example, more preferably 105 μm or more, and still more preferably 110 μm.

An upper limit of the average spacing Sm of the unevenness on the outer peripheral surface of the charging member is, for example, preferably 200 μm or less, and more preferably 150 μm or less.

A ratio Sm/Rz1 of the average spacing Sm of the unevenness to the ten-point average roughness Rz1 on the outer peripheral surface of the charging member is, for example, preferably 15 or more. The driven failure of the charging member is further suppressed by setting the ratio Sm/Rz1 to the above range. In addition, foreign matters such as toner and external additives are less likely to adhere to the outer peripheral surface of the charging member, and contamination of the charging member is suppressed. Therefore, a streaky image defect is easily suppressed.

The ratio Sm/Rz1 is, for example, preferably 20 or more, and more preferably 25 or more. Here, from the viewpoint of suppressing a streaky image defect due to contamination of the charging member, the upper limit of the ratio Sm/Rz1 is, for example, preferably 50 or less, and more preferably 35 or less.

Here, the ten-point average roughness Rz1 is measured in accordance with JIS B 0601: 1994. The ten-point average roughness Rz1 is measured using a contact-type surface roughness measuring device (SURFCOM 570A, manufactured by Tokyo Seimitsu Co., Ltd.) in an environment of 23° C. and 55% RH. The evaluation length is 4.0 mm, the reference length is 0.8 μm, the cutoff value is 0.8 mm, and a contact needle having a diamond (5 μmR, 90° cone) at the tip is used for measurement. An average value thereof is calculated. An average value of values obtained by measuring a 20 mm inside from the each of both ends of the elastic layer of the charging member and a center portion thereof, along an axial direction of the charging member is defined as the ten-point average roughness Rz1.

Further, the average spacing Sm of the unevenness is measured in accordance with JIS B 0601: 1994. The average spacing Sm of the unevenness is a sum of lengths of average lines corresponding to one peak and one valley adjacent thereto in an extracted portion by extracting the reference length from the roughness curve in a direction of the average line, and the arithmetic average value of spacings of the large number of unevennesses is expressed in micrometers (μm). The average spacing Sm of the unevenness is measured using a contact-type surface roughness measuring device (SURFCOM 570A, manufactured by Tokyo Seimitsu Co., Ltd.) in an environment of 23° C. and 55% RH. The evaluation length is 4.0 mm, the reference length is 0.8 μm, the cutoff value is 0.8 mm, and a contact needle having a diamond (5 μmR, 90° cone) at the tip is used for measurement. An average value thereof is calculated. An average value of values obtained by measuring a 20 mm inside from the each of both ends of the elastic layer of the charging member and a center portion thereof, along an axial direction of the charging member is defined as the average spacing Sm of the unevenness.

Examples of a method of controlling the ten-point average roughness Rz1, the average spacing Sm of the unevenness, and the ratio Sm/Rz1 within the above ranges include a method of controlling by adjusting a kind, a volume average particle diameter, and a content of the particles for forming unevenness by adding the particles for forming unevenness to the surface layer.

EXAMPLES

Hereinafter, exemplary embodiments of the invention will be described in detail with reference to Examples, but the exemplary embodiments of the invention are not limited to these Examples. In the following description, "part" is based on mass unless otherwise specified.

Preparation of Photoreceptor

Photoreceptor A1

Formation of Undercoat Layer 100 parts by mass of zinc oxide (average particle diameter 70 nm: manufactured by Teika Co., Ltd: specific surface area value 15 m2/g) and 500 parts by mass of toluene are stirred and mixed, and 1.3 parts by mass of a silane coupling agent (KBM503: manufactured by Shin-Etsu Chemical Co., Ltd.) is added thereto and stirred for 2 hours. Then, toluene is distilled off by vacuum distillation and baked at 120° C. for 3 hours to obtain zinc oxide surface-treated with a silane coupling agent. 110 parts by mass of the surface-treated zinc oxide is stirred and mixed with 500 parts by mass of tetrahydrofuran, a solution in which 0.6 parts by mass of alizarin is dissolved in 50 parts by mass of tetrahydrofuran is added thereto, and the mixture is stirred at 50° C. for 5 hours. Then, zinc oxide to which alizarin is added is filtered off by vacuum filtration, and further dried under reduced pressure at 60° C. to obtain zinc oxide to which alizarin is added.

38 parts by mass of liquid in which 60 parts by mass of zinc oxide to which this alizarin is added, 13.5 parts by mass of a curing agent (blocked isocyanate DESMODUR 3175, manufactured by Sumitomo Covestro Urethane Co., Ltd), 15 parts by mass of a butyral resin (S-LEC BM-1, manufactured by Sekisui Chemical Industry Co., Ltd.) are mixed with 85 parts by mass of methyl ethyl ketone and 25 parts by mass of methyl ethyl ketone are mixed, and dispersed by a sand mill for 2 hours using glass beads having a diameter of 1 mmφ to obtain a dispersion. 0.005 parts by mass of dioctyltin dilaurate and 40 parts by mass of silicone resin particles (Tospearl 145, manufactured by Momentive Performance Materials) are added to the obtained dispersion as a catalyst to obtain a coating liquid for forming an undercoat layer. The coating liquid for forming an undercoat layer is applied onto an aluminum base material by a dip coating method and dried and cured at 170° C. for 40 minutes to obtain an undercoat layer having a thickness of 20 μm.

Formation of Charge Generating Layer

A mixture consisting of 15 parts by mass of hydroxygallium phthalocyanine (CGM-1) having diffraction peaks at positions at Bragg angles (2θ±0.2°) of an X-ray diffraction spectrum using Cukα characteristic X-ray of at least 7.3°, 16.0°, 24.9°, 28.0° as the charge generating material, 10 parts by mass of vinyl chloride/vinyl acetate copolymer resin (VMCH, manufactured by Nippon Unicar Co., Ltd.) as a binder resin, and 200 parts by mass of n-butyl acetate is dispersed in a sand mill for 4 hours using glass beads having a diameter of 1 mmφ. 175 parts by mass of n-butyl acetate and 180 parts by mass of methyl ethyl ketone are added to the obtained dispersion and stirred to obtain a coating liquid for forming a charge generating layer. The coating liquid for forming a charge generating layer is immersed and applied onto the undercoat layer and dried at room temperature (25° C.) to form a charge generating layer having a thickness of 0.2 μm.

Formation of Charge Transporting Layer

Next, 45 parts by mass of N,N'-diphenyl-N,N'-bis(3-methylphenyl)-[1,1']biphenyl-4,4'-diamine (TPD), and 55 parts by mass of a bisphenol Z polycarbonate resin (viscosity average molecular weight: 50,000) as the binder resin are added to 800 parts by mass of tetrahydrofuran (THF)/toluene mixed solvent (mass ratio 70/30) and dissolved to obtain a coating liquid for forming a charge transporting layer. This coating liquid for forming a charge transporting layer is applied onto the charge generating layer and dried at 130° C. for 45 minutes to form a charge transporting layer having a film thickness of 20 μm.

Formation of Organic Protective Layer 30 parts by mass of the following reactive charge transporting material (RCTM), 0.2 parts by mass of colloidal silica (trade name: PL-1, manufactured by Fuso Chemical Industries, Ltd.), 30 parts by mass of toluene, 0.1 parts by mass of 3,5-di-t-butyl-4-hydroxytoluene (BHT), 0.1 parts by mass of azoisobutyronitrile (10-hour half-life temperature: 65° C.), and V-30 (manufactured by Wako Pure Chemical Industries, Ltd., 10-hour half-life temperature: 104° C.) are added to prepare a coating liquid for forming a surface protective layer. This coating liquid is applied onto the charge transporting layer by a spray coating method, air-dried at a room temperature for 30 minutes, then heated under a nitrogen stream at an oxygen concentration of 110 ppm from a room temperature to 150° C. over 30 minutes, and further subjected to a heating treatment at 150° C. for 30 minutes and cured to form a surface protective layer having a film thickness of 10 μm.

As described above, a photoreceptor A1 is obtained.

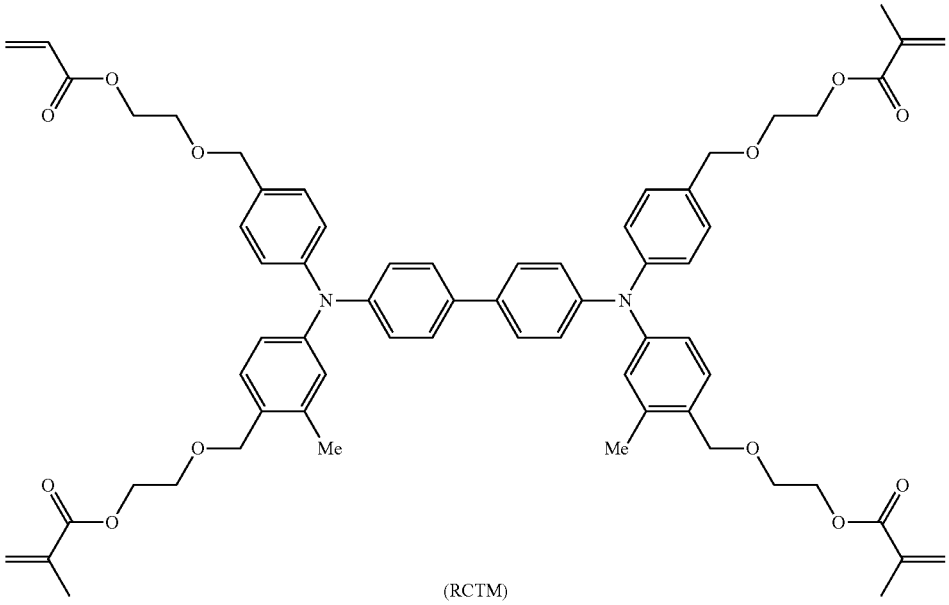

(RCTM)

Photoreceptor A2

The photoreceptor A2 is obtained in the same manner as the photoreceptor A1 except that the surface of the photoreceptor is polished to adjust the ten-point average roughness Rz2 to values shown in Table 1.

Photoreceptor B1

The charge transporting layer is formed in the same manner as the photoreceptor A1.

Formation of Inorganic Protective Layer

Next, the photoreceptor formed up to the charge transporting layer is placed on a substrate support member in a film forming chamber of a film forming apparatus, and vacuum exhausted through an exhaust port into the film forming chamber until pressure reached 0.1 Pa. This vacuum exhaust is performed within 5 minutes after completion of replacement of the high-concentration oxygen-containing gas.

Next, He-diluted 40% oxygen gas (flow rate 1.6 sccm) and hydrogen gas (flow rate 50 sccm) are introduced from a gas introduction tube into a high-frequency discharge tube section provided with a flat plate electrode having a diameter of 85 mm, and a 13.56 MHz radio wave is set at an output of 150 W by a high frequency power supply unit and a matching circuit, matched with a tuner, and discharged from a flat plate electrode 219. A reflected wave at this time is 0 W.

Next, trimethylgallium gas (flow rate 1.9 sccm) is introduced from a shower nozzle to a plasma diffusion portion in the film forming chamber via the gas introduction tube. At this time, reaction pressure in the film forming chamber measured by a Baratron vacuum gauge is 5.3 Pa.

In this state, a film is formed for 120 minutes while rotating the photoreceptor formed up to the charge transporting layer at a speed of 500 rpm, and an inorganic protective layer having a film thickness of 5 μm is formed on the surface of the charge transporting layer.

Through the above steps, a photoreceptor B1 is obtained.

Photoreceptor C1

The charge transporting layer is formed in the same manner as the photoreceptor A1. However, the thickness of the charge transporting layer is set to 30 μm.

The photoreceptor formed up to the charge transporting layer is set as a photoreceptor C1.

Production of Charging Member (Hereinafter Referred to as Charging Roll

Charging Roll 1

Preparation of Conductive Base Material

A base material made of SUM23L (JIS G 4804:2008) is plated with electroless nickel having a thickness of 5 μm, and then hexavalent chromic acid is applied to obtain a conductive base material having a diameter of 8 mm.

Formation of Adhesive Layer

Next, the following mixture is mixed with a ball mill for 1 hour, and then an adhesive layer having a film thickness of 10 μm is formed on a surface of the conductive base material by brush coating.

- Chlorinated polypropylene resin (maleic anhydride chlorinated polypropylene resin, SUPERCHLON 930, manufactured by Nippon Paper Chemicals Co., Ltd.): 100 parts
- Epoxy resin (EP4000, manufactured by ADEKA CORPORATION): 10 parts
- Conductive agent (Carbon Black, KetjenBlack EC, KetjenBlack International): 2.5 parts
- Toluene or xylene is used for viscosity adjustment.

Formation of Elastic Layer

- Epichlorohydrin-ethylene oxide-allyl glycidyl ether copolymer rubber (EPION301, manufactured by Osaka Soda Co., Ltd., ethylene oxide component content 59% by mass): 100 parts by mass
- Carbon black (3030B, manufactured by Mitsubishi Chemical Corporation, arithmetic average particle diameter 55 nm): 1 part by mass
- Calcium carbonate (Viscoexcel 30, manufactured by Shiraishi Calcium Co., Ltd.): 30 parts by mass
- Ionic conductive agent (BTEAC, manufactured by Lion Corporation): 1.4 parts by mass
- Vulcanization accelerator (crosslinking accelerator): stearic acid (manufactured by NOF CORPORATION): 1 part by mass
- Vulcanizing agent (crosslinking agent): Sulfur (VULNOC R, manufactured by Ouchi Shinko Kagaku Kogyo Co., Ltd.): 1 part by mass
- Vulcanization accelerator (crosslinking accelerator): Zinc oxide: 1.5 parts by mass The mixture having the composition shown above is kneaded using a tangential pressure kneader and passes through a strainer to prepare a rubber composition. The obtained rubber composition is kneaded with an open roll to form a roll having a diameter of 12 mm on the surface of the prepared conductive base material using an extrusion molding machine via an adhesive layer, and then heated at 165° C. for 50 minutes to obtain a roll-shaped elastic layer. A thickness of the obtained elastic layer is 2 mm, and a volume resistivity is $4\times10^6\Omega\cdot$cm.

Formation of Surface Layer

- Binder resin: N-methoxymethylated nylon 1 (trade name: Fine Resin FR101, manufactured by Namariichi Co., Ltd): 100 parts by mass
- Conductive agent: Carbon black (volume average particle diameter: 43 nm, trade name: MONAHRCH1000, manufactured by Cabot Corporation): 5 parts by mass
- Particles for forming unevenness: Polyamide particles (volume average particle diameter 5 μm, trade name: ORGASO 2001 UD NAT1, manufactured by Arkema): 25 parts by mass A mixture having the above composition is diluted with methanol and dispersed in a bead mill under the following conditions.

Bead material: Glass

Bead diameter: 1.3 mm

Propeller rotation speed: 2,000 rpm

Dispersion time: 60 minutes

The dispersion obtained above is applied to the surface of the elastic layer by a dipping method and then heat-dried at 150° C. for 30 minutes to form a surface layer having a film thickness of 10 μm to obtain a charging roll 1.

Charging Roll 2

In the formation of the elastic layer, a charging roll 2 is obtained in the same manner as the charging roll 1 except that a blending amount of the carbon black is set to 3 parts by mass and a vulcanization condition is set to 165° C. for 70 minutes.

Charging Roll 3

A charging roll 3 is obtained in the same manner as the charging roll 1 except that in formation of the elastic layer, a blending amount of the carbon black is set to 3 parts by mass, the vulcanization condition is set to 165° C. for 70 minutes, and in formation of the surface layer, a blending amount of the particles for forming unevenness (polyamide particles) is set to 27 parts by mass.

Charging Roll 4

A charging roll 4 is obtained in the same manner as the charging roll 1 except that in formation of the elastic layer, a blending amount of the carbon black is set to 3 parts by mass, the vulcanization condition is set to 165° C. for 70 minutes, and in formation of the surface layer, a blending amount of the particles for forming unevenness (polyamide particles) is set to 40 parts by mass.

Charging Roll 5

A charging roll 5 is obtained in the same manner as the charging roll 1 except that in the formation of the elastic layer, as an elastic material, a mixture of 50 parts by mass of epichlorohydrin-ethylene oxide-allyl glycidyl ether copolymer rubber (EPION301, manufactured by Osaka Soda Co., Ltd.) and 50 parts by mass of epichlorohydrin-ethylene oxide-allyl glycidyl ether copolymer rubber (CG102, manufactured by Osaka Soda Co., Ltd., ethylene oxide component content 37% by mass) is used, a blending amount of the carbon black is set to 6 parts by mass, a blending amount of calcium carbonate is set to 40 parts by mass, and a vulcanization condition is set to 165° C. for 60 minutes, and in the formation of the surface layer, a blending amount of particles for forming unevenness (polyamide particles) is set to 12 parts by mass.

Charging Roll 6

A charging roll 6 is obtained in the same manner as the charging roll 1 except that in formation of the elastic layer, a blending amount of the carbon black is set to 3 parts by mass, a blending amount of the ionic conductive agent is set to 1.6 parts by mass, and in formation of the surface layer, a blending amount of the particles for forming unevenness (polyamide particles) is set to 20 parts by mass.

Charging Roll 7

A charging roll 7 is obtained in the same manner as the charging roll 1 except that in formation of the elastic layer, a blending amount of the carbon black is set to 3 parts by mass, the vulcanization condition is set to 165° C. for 70 minutes, and in formation of the surface layer, a blending amount of the particles for forming unevenness (polyamide particles) is set to 5 parts by mass.

Charging Roll C1

A charging roll C1 is obtained in the same manner as the charging roll 1 except that a blending amount of the carbon black of the elastic layer is set to 6 parts by mass, a blending amount of the calcium carbonate is set to 40 parts by mass, the vulcanization condition is set to 165° C. for 70 minutes, and a blending amount of the particles for forming unevenness (polyamide particles) of the surface layer is set to 10 parts by mass.

Examples 1 to 9 and Comparative Examples 1 and 2

In combination shown in Table 1, the photoreceptor and the charging roll are mounted on an image forming apparatus "DocuCentre-VI C7771" manufactured by FUJIFILM Business Innovation Corp.

after traveling 1,000 sheets of paper) are measured. Then, the reduced film thickness (unit is indicated by nm/kcyc) is calculated.

Evaluation of streaky image quality defect due to charging roll contamination (indicated as contamination streak in table)

100,000 halftone images are printed on A4 paper by the image forming apparatus of each example. Moreover, the printed 100,000th image is observed and evaluated according to the following evaluation criteria.

G1: No vertical streaky image quality defects are observed.

G1.5: Some streaky image quality defects are observed, but a density difference from a background is small and slight.

G2: Streaky image quality defects are observed in less than 1% of an image area.

G2.5: Streaky image quality defects are observed in 1% or more and less than 2% of the image area.

G3: Streaky image quality defects are observed in 2% or more and less than 5% of the image area.

G4: Streaky image quality defects are observed in 5% or more of the image area.

TABLE 1

| | Charging roll | | | | | | Photoreceptor | | | Evaluation | |
|---|---|---|---|---|---|---|---|---|---|---|---|
| | Kind | Resistance component Ra (Ω) | Storage elastic modulus G (MPa) | Ten-point average roughness Rzl (μm) | Average spacing Sm of unevenness (μm) | Sm/Rzl | Kind | Friction Coefficient | Ten-point average roughness Rz2 (μm) | Wear rate nm/kcyc | Contamination Streak Grade |
| Example 1 | 1 | $6.3 \times 10^4$ | 3 | 7.5 | 114 | 15.2 | A1 | 0.8 | 2 | 3 | G1 |
| Example 2 | 2 | $6.3 \times 10^4$ | 5 | 7.5 | 114 | 15.2 | A1 | 0.8 | 2 | 3.3 | G2 |
| Example 3 | 3 | $6.3 \times 10^4$ | 5 | 7.8 | 113 | 14.5 | A1 | 0.8 | 2 | 3.3 | G2.5 |
| Example 4 | 4 | $6.3 \times 10^4$ | 5 | 8.5 | 98 | 11.5 | A1 | 0.8 | 2 | 3.3 | G3 |
| Example 5 | 5 | $6.9 \times 10^4$ | 5 | 4.2 | 189 | 45 | A1 | 0.8 | 2 | 3.5 | G1.5 |
| Example 6 | 6 | $6.0 \times 10^4$ | 5 | 6.7 | 148 | 22.1 | A1 | 0.8 | 2 | 2.8 | G2 |
| Example 7 | 7 | $6.3 \times 10^4$ | 5 | 1.8 | 403 | 224 | A1 | 0.8 | 2 | 3.3 | G3.5 |
| Example 8 | 1 | $6.3 \times 10^4$ | 3 | 7.5 | 114 | 15.2 | B1 | 0.6 | 2 | less than 0.1 | G2 |
| Example 9 | 1 | $6.3 \times 10^4$ | 3 | 7.5 | 114 | 15.2 | A2 | 0.7 | 2.2 | 3.1 | G2 |
| Comparative Example 1 | C1 | $6.3 \times 10^4$ | 6 | 3.8 | 199 | 52.4 | A1 | 0.8 | 2 | 3.5 | G4 |
| Comparative Example 2 | 1 | $6.3 \times 10^4$ | 3 | 7.5 | 114 | 15.2 | C1 | 0.9 | 2 | 21 | G1 |

This apparatus is used as the image forming apparatus for each example, and the following evaluation is performed.

Abrasion Rate of Photoreceptor

Using the image forming apparatus of each example, 1,000 sheets of A4 size J paper (manufactured by FUJIFILM Business Innovation Corp.) are subjected to paper feeding traveling. A superimposed voltage in which a direct current voltage and an alternating current voltage are superimposed is applied to the charging roll, and the paper feeding traveling is performed.

Moreover, an initial film thickness of the photoreceptor (that is, a film thickness before paper feeding traveling) and a film thickness after traveling (that is, the film thickness From the above results, it can be seen that in present Examples, an occurrence of a streaky image defect is suppressed, compared to Comparative Example 1.

In Comparative Example 2, it can be seen that although the occurrence of the streaky image defect is suppressed, a wear rate of the photoreceptor deteriorates because the photoreceptor without the protective layer is applied.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an electrophotographic photoreceptor having a friction coefficient of a surface of 0.8 or less;

a charging device including a charging member that is in contact with and charges the surface of the electrophotographic photoreceptor and includes a conductive base material, an elastic layer provided on the conductive base material and having a storage elastic modulus G of 5.0 MPa or less at 100 Hz, and a surface layer provided on the elastic layer, wherein in a Cole-Cole plot obtained by measuring the charging member in a range of 1 MHz to 0.1 Hz by an alternating current impedance method, a resistance component Ra of a capacitive semicircle including 2.5 kHz is $6.3\times10^4\Omega$ or less;

an electrostatic latent image forming device that forms an electrostatic latent image on the charged surface of the electrophotographic photoreceptor;

a developing device that develops the electrostatic latent image formed on the surface of the electrophotographic photoreceptor to form a toner image by a developer containing a toner; and a transfer device that transfers the toner image to a surface of a recording medium.

2. The image forming apparatus according to claim 1, wherein in an outer peripheral surface of the charging member, a ten-point average roughness Rz1 is 8 μm or less, and an average spacing Sm of unevenness is 100 μm or more.

3. The image forming apparatus according to claim 2, wherein the ten-point average roughness Rz1 is 2 μm or more, and the average spacing Sm of the unevenness is 400 μm or less.

4. The image forming apparatus according to claim 2, wherein a ratio Sm/Rz1 of the average spacing Sm of the unevenness to the ten-point average roughness Rz1 is 15 or more.

5. The image forming apparatus according to claim 2, wherein a ratio Sm/Rz1 of the average spacing Sm of the unevenness to the ten-point average roughness Rz1 is 50 or less.

6. The image forming apparatus according to claim 1, wherein the storage elastic modulus G of the elastic layer of the charging member is 3.0 MPa or less at 100 Hz.

7. The image forming apparatus according to claim 1, wherein the electrophotographic photoreceptor has a conductive substrate, a photosensitive layer provided on the conductive substrate, and a protective layer provided on the photosensitive layer.

8. The image forming apparatus according to claim 7, wherein the protective layer is an inorganic protective layer.

9. The image forming apparatus according to claim 1, wherein a ten-point average roughness Rz2 of the surface of the electrophotographic photoreceptor is 2 μm or less.

10. A process cartridge comprising:

an electrophotographic photoreceptor that has a friction coefficient of a surface of 0.8 or less; and a charging device including a charging member that is in contact with and charges the surface of the electrophotographic photoreceptor and includes a conductive base material, an elastic layer provided on the conductive base material and having a storage elastic modulus G of 5.0 MPa or less at 100 Hz, and a surface layer provided on the elastic layer, wherein in a Cole-Cole plot obtained by measuring the charging member in a range of 1 MHz to 0.1 Hz by an alternating current impedance method, a resistance component Ra of a capacitive semicircle including 2.5 kHz is $6.3\times10^4\Omega$ or less;

wherein the process cartridge is attached to and detached from an image forming apparatus.

11. The process cartridge according to claim 10, wherein in an outer peripheral surface of the charging member, a ten-point average roughness Rz1 is 8 μm or less, and an average spacing Sm of unevenness is 100 μm or more.

12. The process cartridge according to claim 11, wherein the ten-point average roughness Rz1 is 2 μm or more, and the average spacing Sm of the unevenness is 400 μm or less.

13. The process cartridge according to claim 11, wherein a ratio Sm/Rz1 of the average spacing Sm of the unevenness to the ten-point average roughness Rz1 is 15 or more.

14. The process cartridge according to claim 11, wherein a ratio Sm/Rz1 of the average spacing Sm of the unevenness to the ten-point average roughness Rz1 is 50 or less.

15. The process cartridge according to claim 10, wherein the storage elastic modulus G of the elastic layer of the charging member is 3.0 MPa or less at 100 Hz.

16. The process cartridge according to claim 10, wherein the electrophotographic photoreceptor has a conductive substrate, a photosensitive layer provided on the conductive substrate, and a protective layer provided on the photosensitive layer.

17. The process cartridge according to claim 16, wherein the protective layer is an inorganic protective layer.

18. The process cartridge according to claim 10, wherein a ten-point average roughness Rz2 of the surface of the electrophotographic photoreceptor is 2 μm or less.

* * * * *